US006317095B1

(12) United States Patent
Teshirogi et al.

(10) Patent No.: US 6,317,095 B1
(45) Date of Patent: Nov. 13, 2001

(54) PLANAR ANTENNA AND METHOD FOR MANUFACTURING THE SAME

(75) Inventors: Tasuku Teshirogi, Tokyo; Aya Yamamoto, Kawasaki, both of (JP)

(73) Assignee: Anritsu Corporation, Tokyo (JP)

( * ) Notice: Subject to any disclaimer, the term of this patent is extended or adjusted under 35 U.S.C. 154(b) by 0 days.

(21) Appl. No.: 09/554,470

(22) PCT Filed: Aug. 11, 1999

(86) PCT No.: PCT/JP99/04354

§ 371 Date: May 11, 2000

§ 102(e) Date: May 11, 2000

(87) PCT Pub. No.: WO00/19559

PCT Pub. Date: Apr. 6, 2000

(30) Foreign Application Priority Data

Sep. 30, 1998 (JP) ..... 10-278324
Dec. 11, 1998 (JP) ..... 10-359692

(51) Int. Cl.[7] ..... H01Q 13/00
(52) U.S. Cl. ..... 343/785; 343/770; 343/776
(58) Field of Search ..... 343/785, 786, 343/767, 768, 776, 770, 771, 700 MS, 753, 754, 755; H01Q 13/00

(56) References Cited

U.S. PATENT DOCUMENTS

| | | | | |
|---|---|---|---|---|
| 3,235,869 | * | 2/1966 | Van Atta et al. | 343/785 |
| 3,277,489 | * | 10/1966 | Blaisdell | 343/777 |
| 4,516,131 | | 5/1985 | Bayha et al. . | |
| 5,173,714 | * | 12/1992 | Arimura et al. | 343/771 |
| 5,416,492 | * | 5/1995 | Takahashi et al. | 343/771 |
| 5,661,493 | * | 8/1997 | Uher et al. | 343/700 MS |

FOREIGN PATENT DOCUMENTS

| | | |
|---|---|---|
| 50-57752 | 5/1975 | (JP) . |
| 55-154803 | 12/1980 | (JP) . |
| 62-126701 | 6/1987 | (JP) . |
| 64-36202 | 2/1989 | (JP) . |
| 2-302104 | 12/1990 | (JP) . |
| 3-283902 | 12/1991 | (JP) . |
| 5-183333 | 7/1993 | (JP) . |
| 5-506759 | 9/1993 | (JP) . |
| 7-44091 | 10/1995 | (JP) . |
| 8-321710 | 12/1996 | (JP) . |
| 9-502587 | 3/1997 | (JP) . |
| 11-234036 | 8/1999 | (JP) . |

OTHER PUBLICATIONS

K. Solbach; "E–Band Leaky Wave Antenna Using Dielectric Image Line with Etched Radiating Elements"; 1979; pp. 214–216; IEEE MTT, International Microwave Symposium.

* cited by examiner

*Primary Examiner*—Hoanganh Le
(74) *Attorney, Agent, or Firm*—Frishauf, Holtz, Goodman, Langer & Chick, P.C.

(57) ABSTRACT

The present invention provides a planar antenna which has a decreased transmission loss, improved aperture efficiency, increased productivity, and reduced cost when it is used in a high-frequency band such as submillimeter and millimeter wave bands, and which allows multibeam scanning and electronic-beam scanning with a thin, simple structure. According to one aspect of the present invention, the planar antenna includes a planar ground conductor, a plurality of radiating dielectrics arranged in parallel and at established intervals on a surface of the ground conductor, and a plurality of perturbations for radiating an electromagnetic wave. The perturbations each have a given width and are arranged at established intervals on a top surface of each of the plurality of radiating dielectrics along a longitudinal direction thereof, and a feeding section is provided alongside one end of each of the plurality of radiating dielectrics for feeding an electromagnetic wave to respective lines formed by each of the radiating dielectrics and the ground conductor.

22 Claims, 20 Drawing Sheets

$f_0$ = 76.5 [GHz], $\varepsilon$ =9.7, a=2b=1.0 [mm], WHOLE LENGTH : 50mm
DESIGN VALUE : MAIN-BEAM DIRECTION = -10° ,SLL= -20dB

PLANAR ANTENNA AND METHOD FOR MANUFACTURING THE SAME

TECHNICAL FIELD

The present invention relates to a planar antenna and a method for manufacturing the same and, more particularly, to a planar antenna which is used in submillimeter wave and millimeter wave bands, which has an improved aperture efficiency and simplified structure, and which allows multibeam scanning and electronic-beam scanning, and a method for manufacturing such a planar antenna.

BACKGROUND ART

Recently it has been required in a radio communication system, a radar system and the like that an antenna should be decreased in size and thickness according to miniaturization of electronic circuits.

Since the aperture area of the antenna almost depends upon the frequency and gain of the antenna required in the system, it is important that the antenna should be thinned to decrease the volume of the whole antenna.

Conventionally, in order to attain the above object, a microstrip array antenna and a waveguide slot array antenna have been put to practical use as a typical thin planar antenna.

In the microstrip array antenna, a microstrip is formed on a substrate and employed as an antenna element. Since the antenna element can be manufactured by printing technique, the microstrip array antenna is relatively easy to manufacture.

The microstrip array antenna has a drawback in which a frequency band is narrow and a transmission loss of a feeder in an millimeter wave band is considerably larger than that in a microwave band.

The microstrip array antenna is therefore applied to only an array constituted of a few elements and it is not suitable for a system requiring a high gain antenna such as high-speed-and-large-capacity communications and high-resolution sensing in which the use of millimeter waves is expected.

On the other hand, the waveguide slot array antenna includes a waveguide having a slot as an antenna element. For example, a waveguide slot array antenna as described in Jpn. U.M. Appln. KOKOKU Publication No. 7-44091 is known in which a plurality of radiating waveguides are so arranged that one end portion of each radiating waveguide is hit against the side of a feeding waveguide to feed power from the feeding waveguide to each of the radiating waveguides.

Such a waveguide slot array antenna decreases in transmission loss in a high-frequency band such as submillimeter and millimeter wave bands and is therefore suitable for a system that necessitates a high-gain antenna.

In the waveguide slot array antenna, however, the feeding waveguide and the plurality of radiating waveguides are generally formed by vertically fixing a side wall for the feeding waveguide and the radiating waveguides on a common base and fixing a slot plate for the plurality of radiating waveguides thereon.

For this reason, the waveguide slot array antenna so constituted necessitates a manufacture process such as welding in order to complete electrical contact between the upper edges of side walls of the waveguides and the slot plate, and has problems in which its productivity is low and its price is difficult to lower.

In order to resolve the structural problems of the waveguide slot array antenna, there is proposed a method for feeding power to adjacent waveguides in opposite phases to make the side walls of the waveguides and the surface of the slot not contact with each other.

The above method, however, had a problem in which the waveguides were easily joined with each other and the antenna characteristics were degraded.

Further, an antenna used for a car-mounted radar is not only small but also requires a beam scan in order to detect an obstacle with high resolution and prevent an error in detection due to a difference between the direction of the body of a car running on a curve and that of the running car.

To meet the above requirements, conventionally, a method for scanning with a beam by mechanically moving a radar antenna has been employed.

Such a mechanical beam scanning method has drawbacks in which a radar apparatus is increased in size for a driving mechanism and decreased in reliability.

It is thus desired that an electronic beam scanning method be put to practical use in place of mechanical beam scanning.

As an electronic beam scanning method, there are a method for switching a plurality of antennas having different beam directions by means of a switch and a so-called phased array antenna for varying a phase of feeding to a plurality of antennas by a variable phase shifter and then varying a direction of a synthesized beam.

Since the former method makes use of only some of the plurality of antennas, there occurs a problem in which the whole antenna is increased in size in order to obtain a narrow beam and a high gain.

The latter method has a problem in which beams need to be synthesized using a variable phase shifter for each antenna and thus the antenna is complicated in structure and increased in cost.

DISCLOSURE OF INVENTION

The present invention is made in consideration of the above situation and its object is to resolve the problems of the prior art and provide a planer antenna which has a decreased transmission loss, improved aperture efficiency, increased productivity, and reduced cost when it is used in a high-frequency band such as submillimeter and millimeter wave bands, and which allows multibeam scanning and electronic-beam scanning with a thin, simple structure.

In order to attain the above object, a planar antenna according to one aspect of the present invention, comprises:

- a planar ground conductor;
- a plurality of radiating dielectrics arranged in parallel and at established intervals on a surface of the ground conductor;
- a plurality of perturbations for radiating an electromagnetic wave, the perturbations each having a given width and being arranged at established intervals on a top surface of each of the plurality of radiating dielectrics along a longitudinal direction thereof; and
- a feeding section, provided alongside one end of each of the plurality of radiating dielectrics, for feeding an electromagnetic wave to respective lines formed by each of the radiating dielectrics and the ground conductor.

In order to also attain the above object, a method for manufacturing a planar antenna according to another aspect of the present invention, comprises:

a step of preparing a planar ground conductor;

a step of preparing a plurality of radiating dielectrics to be arranged in parallel and at established intervals on a surface of the ground conductor;

a step of preparing a plurality of perturbations for radiating an electromagnetic wave, the perturbations each having a given width (s) and arranged at established intervals (d) on a top surface of each of the plurality of radiating dielectrics along a longitudinal direction thereof;

a step of previously plotting a curve group of fixed radiant quantities or leaky coefficients for each wavelength of the electromagnetic wave radiated from the plurality of perturbations and a curve group of fixed beam directions with respect to the width (s) and the intervals (d), and preparing a given number of interpolated curve groups, thereby obtaining the width (s) and the intervals (d) from an intersection point between a curve of an arbitrary leaky coefficient and that of an arbitrary beam direction; and a step of preparing a feeding section to be arranged alongside one end of each of the plurality of radiating dielectrics, for feeding an electromagnetic wave to lines constituted of the radiating dielectrics and the ground conductor.

BEST MODE FOR CARRYING OUT THE INVENTION

Figure 1:
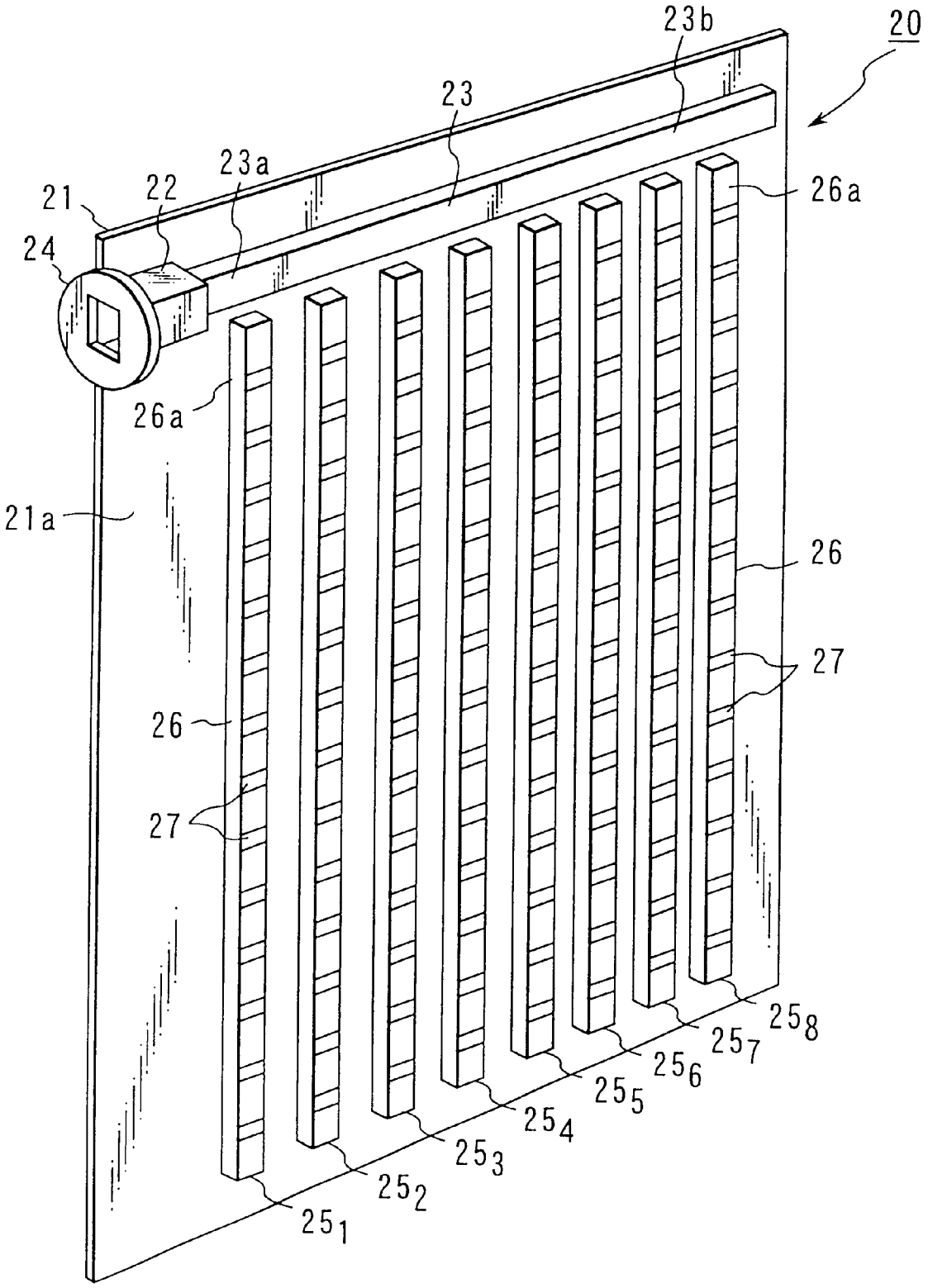
FIG. 1 is a perspective view showing the structure of a planar antenna according to a first embodiment of the present invention.

First an overview of the present invention will be described.

In order to attain the above-described object, a first planar antenna according to the present invention comprises:

a ground conductor (21);

a plurality of radiating dielectrics (26) arranged in parallel on the surface of the ground conductor, the radiating dielectrics having a rectangular section and being shaped like a rod, an image line for an electromagnetic wave being formed between each of the radiating dielectrics and the ground conductor;

a plurality of perturbations (27) arranged at nearly regular intervals on a top surface of each of the dielectrics along a longitudinal direction thereof, for causing an electromagnetic wave to leak and radiate from the surface of each of the radiating dielectrics; and a feeding section (22) provided alongside one end of each of the plurality of radiating dielectrics on the surface of the ground conductor, for feeding an electromagnetic wave toward the one end of each of the plurality of radiating dielectrics.

A second planar antenna of the present invention according to the first planar antenna described above, is characterized in that the feeding section includes a feeding image line (23) provided on the surface of the ground conductor so as to separate from the plurality of radiating dielectrics and intersect the plurality of radiating dielectrics at right angles and an input section (24) for supplying an electromagnetic wave to one end (23*a*) of the feeding image line, and the electromagnetic wave input through the input section is fed from the side of the feeding image line toward the one end of each of the plurality of radiating dielectrics.

A third planar antenna of the present invention according to the first planar antenna described above, is characterized in that the feeding section includes an electromagnetic horn (42) formed on the ground conductor such that an aperture thereof, on the radiating side, intersects the plurality of radiating dielectrics at right angles.

A fourth planar antenna of the present invention according to the third planar antenna described above, is characterized in that the electromagnetic horn is an H-plane sectoral horn (42), and the plurality of radiating dielectrics each have an elongated portion (48) at one end, the elongated portion extending inside the H-plane sectoral horn to convert a cylindrical wave of the H-plane sectoral horn into a plane wave and guide the plane wave to the radiating dielectrics.

A fifth planar antenna of the present invention according to the third or fourth planar antenna described above, is characterized in that the electromagnetic horn includes a plurality of metal plates (44) on an upper edge of an aperture (43) thereof on the radiating side, the plurality of metal plates, which are parallel with a center axis of the electromagnetic horn and perpendicular to the ground conductor, being arranged at intervals each corresponding to not more than half of a free-space wavelength of the electromagnetic wave so as to interpose each of the radiating dielectrics therebetween.

A sixth planar antenna of the present invention according to the first planar antenna described above, is characterized in that the radiating dielectrics each have an elongated portion (68) at one end, the elongated portion extending toward the feeding section so as to form a bifocal electromagnetic lens, and the feeding section includes:

a plurality of feeding radiators (72) which are arranged on the ground conductor such that the radiation center is located on a line connecting two focal points of the bifocal electromagnetic lens or near the line and the radiation face is directed to the bifocal electromagnetic lens; and a guide (75) for converting an electromagnetic wave radiating from the plurality of feeding radiators into a cylindrical wave and feeding the cylindrical wave to the elongated portions of the radiating dielectrics, the ends of the feeding radiators and the elongated portions of the radiating dielectrics being interposed between the guide and the ground conductor, the electromagnetic wave radiating from the feeding radiators being fed to the plurality of radiating dielectrics with a phase difference corresponding to the radiation center of the electromagnetic wave, and the antenna having beam directions varying from feeding radiator to feeding radiator.

A seventh planar antenna of the present invention according to the sixth planar antenna described above, is characterized in that the guide includes a plurality of metal plates (44) on an upper edge of an aperture thereof alongside the radiating dielectrics, the metal plates, which are parallel with the center line of the bifocal electromagnetic lens and perpendicular to the ground conductor, being arranged at intervals each corresponding to not more than half of a free-space wavelength of the electromagnetic wave so as to interpose each of the radiating dielectrics therebetween.

An eighth planar antenna of the present invention according to the sixth or seventh planar antenna described above, is characterized in that the beam directions of the antenna are scanned by controlling select means (80), the select means allowing the plurality of feeding radiators to be used selectively.

A ninth planar antenna of the present invention according to the eighth planar antenna described above, is characterized in that the plurality of feeding radiators have a waveguide structure whose inner wall partly corresponds to the ground conductor, and the ground conductor includes coupling slots (92) on the inner walls of the feeding radiators, and the select means comprises:

a dielectric substrate (93) fixed on opposite sides of the plurality of feeding radiators with the ground conductor interposed therebetween;

a plurality of probes (94) formed on the dielectric substrate so as to cross the coupling slots of the plurality of feeding radiators with the dielectric substrate interposed therebetween;

a transmit/receive terminal (96) formed on the dielectric substrate;

a plurality of diodes (95) mounted on the dielectric substrate, one electrode of each of the diodes being connected to a corresponding one of the probes, and other electrodes of the diodes being connected in common to the transmit/receive terminal;

a plurality of bias terminals (99, 100) for applying a bias voltage to the plurality of diodes from outside; and a plurality of low-pass filters (97, 98) for connecting the bias terminals and the electrodes of the diodes in a direct-current manner on the dielectric substrate, preventing a high frequency from being transmitted from the diodes to the bias terminals, and applying a bias voltage, applied to a bias terminal, to a diode corresponding to the bias terminal.

A tenth planar antenna of the present invention according to the eighth or ninth planar antenna described above, is characterized in that the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a receiving terminal formed on the dielectric substrate;

a plurality of receiving modules mounted on the dielectric substrate and having inputs connected to the plurality of probes, respectively, each of the receiving modules being constituted of a low-noise amplifier and a mixer;

a terminal for supplying a local oscillation signal to each mixer of the receiving modules from outside; and a plurality of intermediate-frequency-band switches whose inputs are connected to outputs of the plurality of receiving modules, respectively and whose outputs are connected to the receiving terminal.

An eleventh planar antenna of the present invention according to the eighth or ninth planar antenna described above, is characterized in that the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a transmitting terminal formed on the dielectric substrate;

a plurality of transmitting modules mounted on the dielectric substrate and having outputs connected to the plurality of probes, respectively, each of the transmitting modules being constituted of a power amplifier and a mixer;

a terminal for supplying a local oscillation signal to each mixer of the transmitting modules from outside; and a plurality of intermediate-frequency-band switches whose outputs are connected to inputs of the plurality of transmitting modules, respectively and whose inputs are connected to the transmitting terminal.

A twelfth planar antenna of the present invention according to the first planar antenna described above, is characterized in that the feeding section comprises:

an H-plane sectoral horn provided on a back of the ground conductor and having a feeding radiator;

a parabolic cylindrical reflector coupled at one end to an end portion of the H-plane sectoral horn and disposed at a feeding end of the radiating dielectric such that a focal point coincides with a phase center of the radiating dielectric; and an upper plate coupled to another end of the parabolic cylindrical reflector to thereby form a parallel plate waveguide between the upper plate and the ground conductor, and an electromagnetic wave returns from the back of the ground conductor to the surface thereof with a single beam.

A thirteenth planar antenna of the present invention according to the first planar antenna described above, is characterized in that the feeding section comprises:

an H-plane sectoral horn provided on a back of the ground conductor and having a feeding radiator;

a parabolic cylindrical reflector coupled at one end to an end portion of the H-plane sectoral horn and disposed at a feeding end of the radiating dielectric such that a focal point coincides with a phase center of the radiating dielectric; and an upper plate coupled to another end of the parabolic cylindrical reflector to thereby form a parallel plate waveguide between the upper plate and the ground conductor, and an electromagnetic wave returns from the back of the ground conductor to the surface thereof with a multi-beam.

A fourteenth planar antenna of the present invention according to the first planar antenna described above, is characterized in that a dielectric, which is formed of a same material as that of the radiating dielectric, expands over a top surface of the ground conductor, and a height of the dielectric is not greater than about ⅔ that of the radiating dielectric.

A fifteenth planar antenna of the present invention according to the first planar antenna described above, is characterized in that the plurality of perturbations each have a given width corresponding a position thereof, and an interval between adjacent perturbations is set to a nonuniform value.

A sixteenth planar antenna of the present invention according to the first planar antenna described above, is characterized in that the feeding section includes:

a feeding radiator (72) closed at one end opposed to a radiation face;

a coupling slot (92) provided on the ground conductor, which forms an inner wall of the feeding radiator, in a direction perpendicular to a longitudinal direction of the feeding radiator;

a dielectric substrate (93) mounted on a back of the ground conductor in a position corresponding to the feeding radiator; and a probe (94) formed on the dielectric substrate so as to cross the coupling slot at one end, for transmitting an input electromagnetic wave.

Embodiments of the present invention, which are based on the overview described above, will now be described with reference to the accompanying drawings.

First Embodiment

FIG. 1 illustrates the overall structure of a millimeter-wave planar antenna 20 according to a first embodiment of the present invention.

Figure 2:
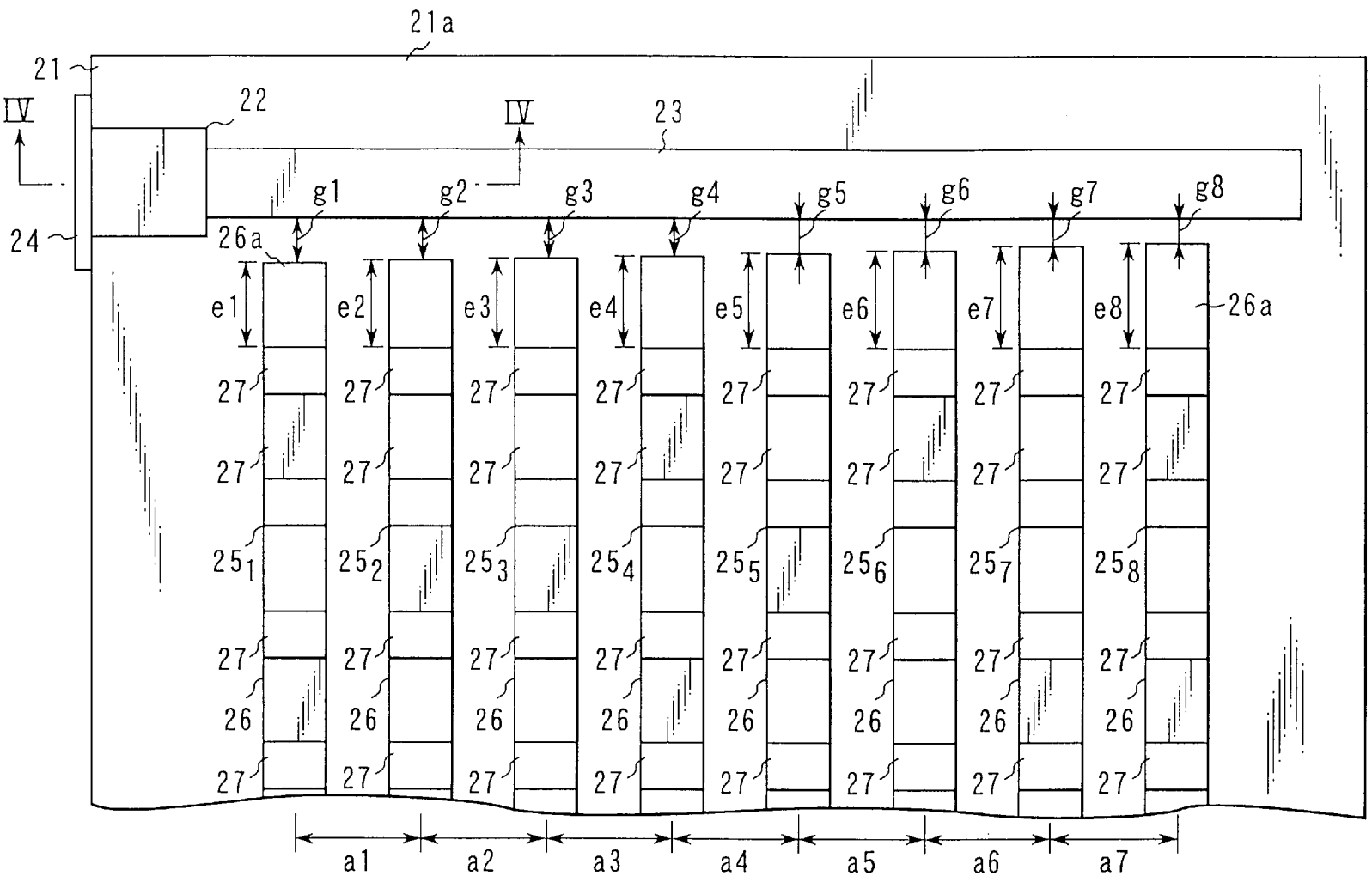
FIG. 2 is an enlarged front view of a major part of the planar antenna shown in FIG. 1.

FIG. 2 shows an enlarged major part of the antenna of FIG. 1.

As shown in FIGS. 1 and 2, the planar antenna 20 is formed on the surface 21*a* of a rectangular ground conductor 21.

An image-line type feeding section 22 is provided on the surface 21*a* of the ground conductor 21 in the upper parts of the Figures.

The feeding section 22 includes a feeding dielectric 23 shaped like a bar having a rectangular section and having a given length and a waveguide 24 connected to one end 23*a* of the feeding dielectric 23 as an input section for receiving an electromagnetic wave.

The feeding dielectric 23 is made of, e.g., resin fluoride (e.g., Teflon=trademark), and an image line is formed between the dielectric 23 and the ground conductor 21 to transmit an electromagnetic wave, which is input through the waveguide 24, from the one end 23*a* to the other end 23*b*.

Such a transmission path formed by the dielectric transmits an electromagnetic wave therein while leaking it from outside.

Figure 3:
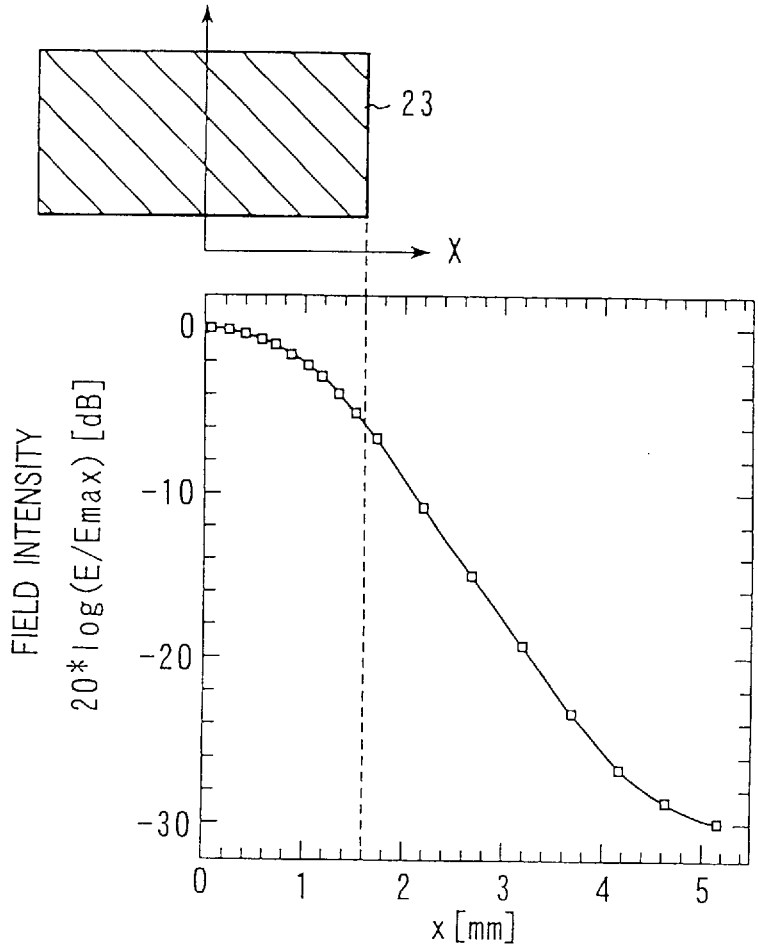
FIG. 3 is a curve showing electric field intensity distribution characteristics of image lines.

If Teflon (trademark) whose section width is 3.2 mm and whose height is 1.6 mm is used as the feeding dielectric 23, the electric field intensity of an electromagnetic wave to be transmitted is maximized in the center (x=0) of the dielectric 23, as shown in FIG. 3. Decreasing with distance from the center, the intensity attenuates as a cosine function inside the dielectric, whereas it attenuates as an exponential function outside.

However, the electromagnetic wave has the electric field intensity of about −10 dB outside the dielectric 23 but near the side thereof, for example, when x is equal to 2 mm.

The feeding section 22 feeds an electromagnetic wave, which leaks out to the side of the dielectric 23, to a plurality of leaky wave antenna elements (hereinafter simply referred to as antenna elements) 251 to 258, which will be described later.

Figure 4:
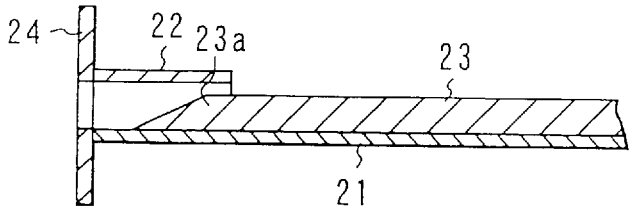
FIG. 4 is a cross-sectional view taken along line IV—IV of FIG. 2.

As shown in FIG. 4, the one end 23*a* of the feeding dielectric 23 enters a transmission path of the waveguide 24 and is tapered so as to match the waveguide 24 and receive an electromagnetic wave with efficiency.

The bottom portion of the waveguide 24 is formed by the ground conductor 21.

As illustrated in FIGS. 1 and 2, a plurality of (8 in the Figures) antenna elements 251 to 258 are arranged at established intervals on the ground conductor 21 opposite to one side of the feeding dielectric 23. These antenna elements are parallel with one another and perpendicular to the feeding dielectric 23.

The antenna elements $\mathbf{25}_1$ to $\mathbf{25}_8$ each include a radiating dielectric 26 and metal strips 27. The dielectric 26 is formed of alumina or the like and shaped like a rod having a rectangular section. The metal strips 27 serve as a plurality of perturbations and are formed on the surface of the radiating dielectric 26 at nearly regular intervals along its longitudinal direction.

Figure 5:
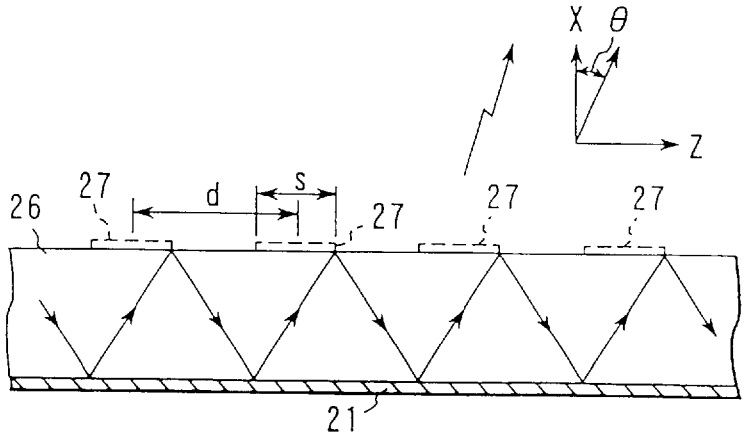
FIG. 5 is a side view for explaining a signal propagation state and a leaky wave of an image line.

Like the feeding dielectric 23, the radiating dielectrics 26 each cause an image line to be formed between the dielectric 26 and the ground conductor 21 to receive at one end 26*a* an electromagnetic wave leaking from the side of the feeding dielectric 23 and transmit it to the other end, as illustrated in FIG. 5.

Since, in the above transmission process, the metal strips 27 are arranged at established intervals on the surface of each of the radiating dielectrics 26 as perturbations, a number of spatial harmonic components are generated in the dielectrics 26, and some of them radiate from the surfaces of the dielectrics 26 as leaky waves, thus causing the planar antenna 20 to function.

In other words, the planar antenna 20 is one type of leaky wave antenna.

The radiation pattern of leaky waves depends upon an interval d between the metal strips 27 (referred to as a strip cycle) and a length s of each metal strip 27 (referred to as a strip width).

The above spatial harmonic βn is expressed by the following equation:

$$\beta n=\beta+2n\pi/d(-\infty\leqq n\leqq\infty)$$

where β is a phase constant of the dielectric line. If βn is smaller than the number k0 of free-space waves, a leaky wave radiates.

If the longitudinal direction z of the dielectric is positive and the free-space wavelength of the leaky wave is λ with reference to the x-axis intersecting the surface of the dielectric at right angles, the radiant direction of the leaky wave is given by the following equation:

$$\theta n=\sin-1\ (\beta n/k0)$$
$$=\sin-1\ [(\beta/k0)+n\lambda 0/d]$$

where $-1\leqq\sin\ \theta n\leqq 1$. Since, in the dielectric, (β/k0) is a constant larger than 1, n is usually equal to −1 in order that On may have an effective solution.

From the above equations, it is judged that the radiant direction of the leaky wave depends upon the strip cycle d.

It is known that the radiant quantities of a leaky wave per unit length (leaky wave constant) almost depend upon the strip width s.

In the planar antenna 20, the antenna elements 251 to 258 have almost the same strip cycle d and strip width s so as to have almost the same radiant characteristics.

According to the conventional design theory, as described above, the cycles d of the metal strips were set almost equal to one other, as were the widths s thereof.

According to the conventional design theory, even when a parameter was changed, the strip cycle d was fixed in order to align the directions of radio beams, and only the strip width s was varied, thus controlling the radiant quantities.

The above examples are disclosed in K. Solbach, "E-Band Leaky Wave Antenna Using Dielectric Image Line with Etched Radiating Elements," IEEE MTT, 1979, International Microwave Symposium, pp. 214–216 and, U.S. Pat. No. 4,516,131, W. T. Bayha et al., "Variable Slot Conductance Dielectric Antenna and Method."

The inventors of the present invention have conducted a close study and clarified that the radiant quantities as well as the beam directions vary as the strip cycle d varies, and the beam directions, not to mention the radiant quantities vary as the strip width s varies.

Figure 24A:
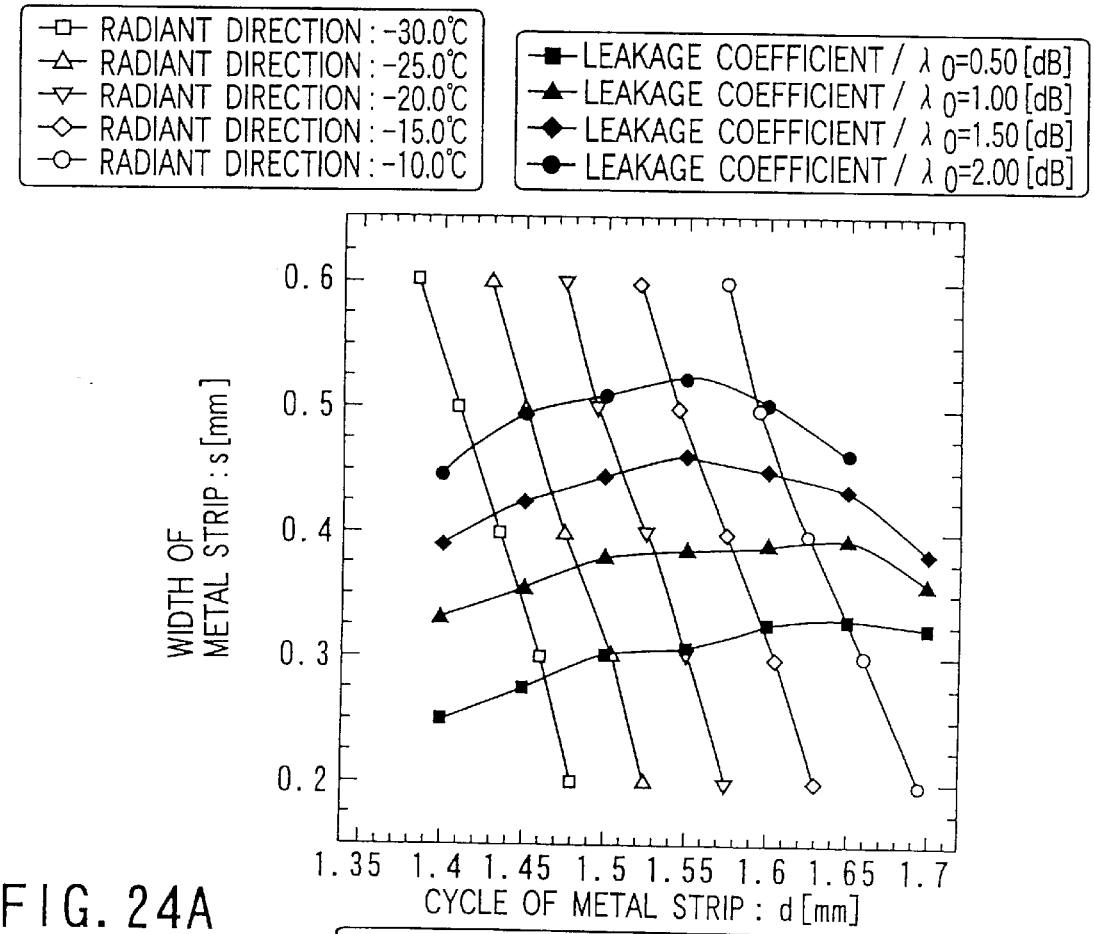
FIG. 24A is a characteristic diagram showing a curve group of fixed radiant quantities or leaky coefficients per wavelength and a curve group of fixed beam directions by plots, with respect to a cycle d and a width s of strips serving as perturbations, in order to appropriately select the cycle d and width s and control both the amplitude and phase of an electric field on the antenna aperture.

If a curve group of fixed radiant quantities or leaky coefficients per wavelength and that of fixed beam directions are plotted with respect to the strip width and cycle s and d, a graph is obtained as shown in FIG. 24A.

If a number of interpolated curve groups are added, a strip width s and a strip cycle d can be obtained from an intersection point between an arbitrary leaky coefficient and an arbitrary beam direction.

The above fact means that if the strip cycle d and strip width s are selected appropriately, both the amplitude and phase of an electric field over the antenna aperture can be controlled.

Consequently, in order to achieve a desired directivity with precision, it is essential only that a local leaky coefficient is obtained so as to distribute desired electric fields over the antenna aperture in view of a transmission loss of a radiating dielectric line and the strip cycle d and strip width s of each perturbation are controlled so at to achieve the distribution.

The feature of the above design method lies in that even when the directions of local radiant beams are all the same, the cycle d of the metal strips is not uniformed and thus the aperture distribution can be controlled with high precision.

Figure 24B:
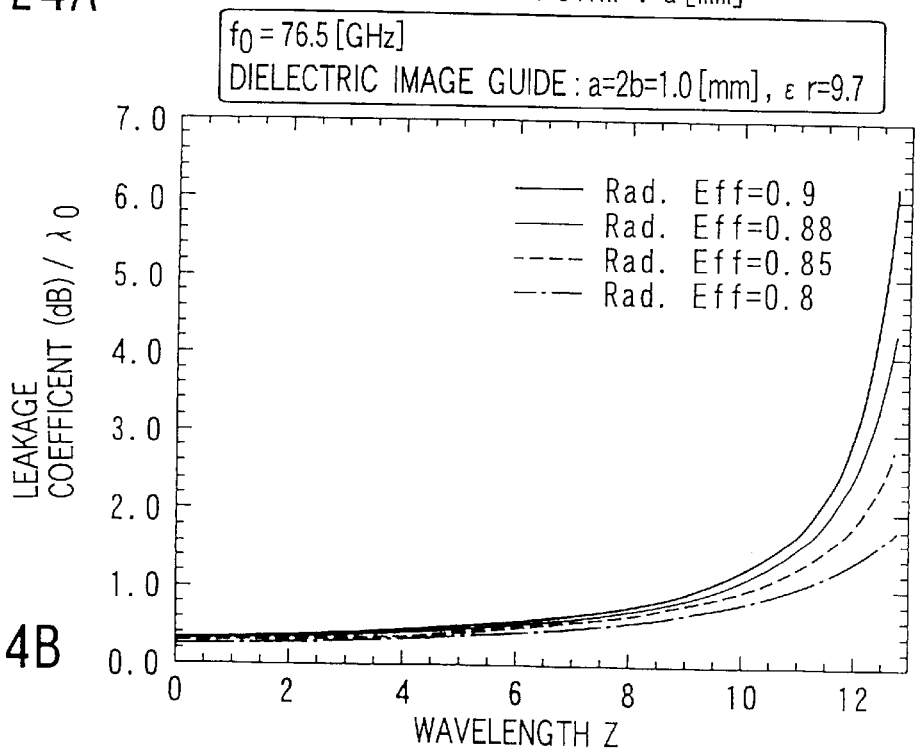
FIG. 24B is a characteristic diagram showing, as another example, the distribution of leaky coefficients required for obtaining the uniform distribution of electric fields when antennas are synthesized so as to form a uniform distribution pattern in which the distribution of electric fields over the antenna aperture is uniformed.
Figure 24C:
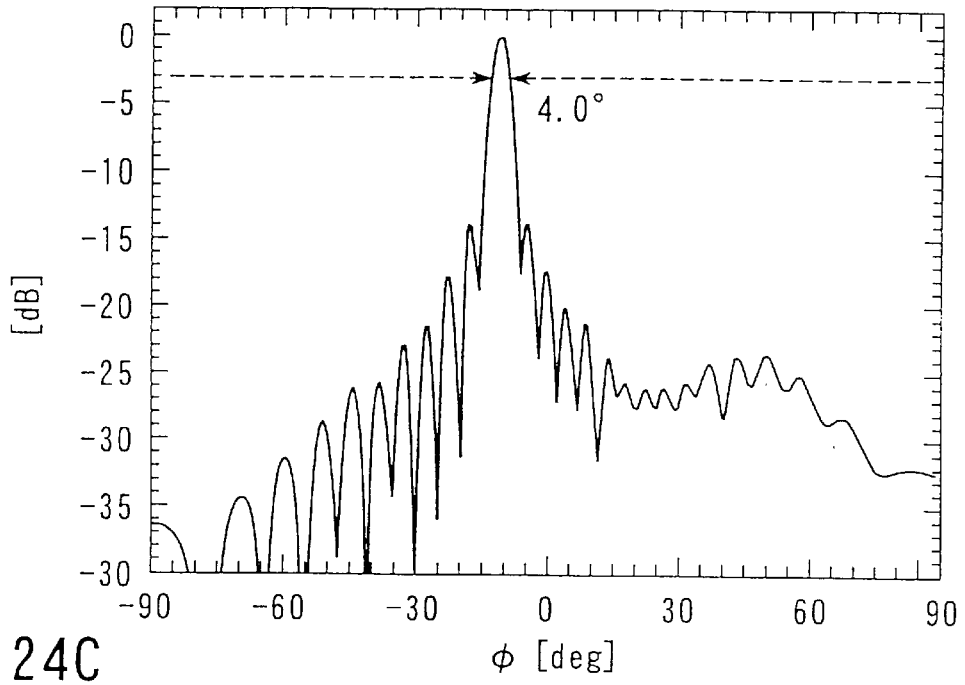
FIG. 24C is a characteristic diagram showing the directivity of an antenna designed using the diagram shown in FIG. 24A in order to achieve a uniform distribution pattern.
Figure 24D:
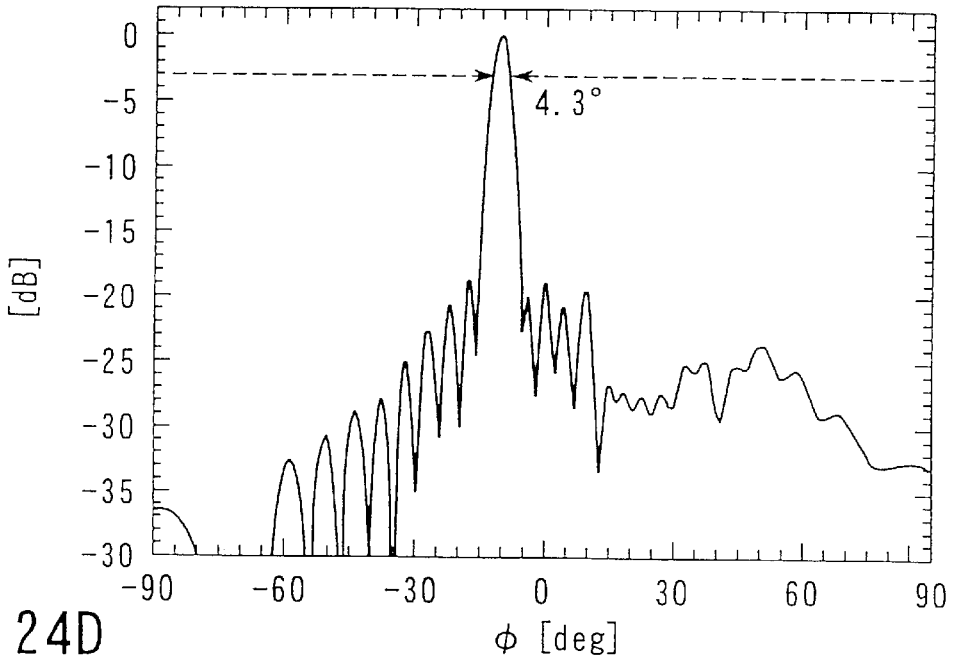
FIG. 24D is a characteristic diagram showing the leaky coefficients over the aperture of an antenna and the directivity of an antenna in which the cycle d and width s of each perturbation are determined so as to achieve the leaky coefficients, when Taylor patterns having a side lobe of 20 dB are synthesized as an example in which the aperture distribution can be controlled with high precision because the cycle d of metal strips is not uniform even though the directions of local radiating beams are the same.

As an example of the above, FIG. 24D shows a synthesized Taylor pattern having a side lobe of 20 dB.

FIG. 24D shows leaky coefficients over the aperture of an antenna, considering a line loss to obtain the Taylor pattern, and directivity of an antenna in which the strop cycle and width d and s of each perturbation are determined so as to achieve the leaky coefficients. It can be confirmed from FIG. 24D that a nearly-desired Taylor pattern having a side lobe of 20 dB is obtained.

As another example, antennas are synthesized so as to form a uniform distribution pattern in which electric fields are distributed uniformly over the antenna aperture.

In order to obtain the uniform distribution of electric fields, the leaky coefficients have to be distributed as illustrated in FIG. 24B.

FIG. 24B shows four curves using the ratio of power radiating in space to power supplied to the antenna or radiation efficiency as a parameter.

FIG. 24C is directed to the directivity of an antenna that is designed based on the graph shown in FIG. 24A in order to attain the uniform distribution pattern described above.

It can be confirmed from FIG. 24C that the first side lobe is very close to a theoretical value −13.2 dB of the uniform distribution directivity.

Consequently, the in-plane directivity of an antenna including antenna elements can be controlled by controlling the strip cycle d and strip width s in respective positions on the antenna elements.

When a highly efficient antenna is required for communications or the like, it is essential only that a strip cycle d and a strip width s be selected such that the aperture distribution along the antenna elements is as uniform as possible. When a low-side lobe like a radar is needed, it is essential only that a strip cycle d and a strip width s be selected so as to obtain a so-called taper distribution in which an electric field is strengthened in the middle antenna element.

In the planar antenna 20, the antenna elements $\mathbf{25}_1$ to $\mathbf{25}_8$ are almost the same in order to facilitate the manufacture thereof, and the aperture distribution in the array direction is controlled by coupling to the feeding dielectric 23 or a feeding horn 42.

As shown in FIG. 2, the gaps between the feeding dielectric 23 and the radiating dielectrics 26 vary little by little and so do the gaps between the radiating dielectrics themselves.

The feeding section 22 feeds an electromagnetic wave to the antenna elements 251 to 258 while transmitting it from one end 23*a* of the feeding dielectric 23 to the other end 23*b* thereof. The amplitude of the electromagnetic wave attenuates toward the end of the dielectric 23.

If, therefore, the distances between the side of the feeding dielectric 23 and the radiating dielectrics 26 of the antenna elements $\mathbf{25}_1$ to $\mathbf{25}_8$ are fixed, no uniform electromagnetic wave is supplied to the antenna elements $\mathbf{25}_1$ to $\mathbf{25}_8$.

To do so, in the planar antenna 20 of the first embodiment, the end portions having lengths e1 to e8 of the radiating dielectrics 26 are increased little by little such that gaps g1 to g8 between the side of the feeding dielectric 23 and the respective antenna elements $\mathbf{25}_1$ to $\mathbf{25}_8$ decrease with distance from one end 23*a* of the feeding dielectric 23 (waveguide 24 side).

In the planar antenna 20, it is the principle that the antenna elements $\mathbf{25}_1$ to $\mathbf{25}_8$ are arranged at intervals each corresponding to the line wavelength of the feeding dielectric 23 in order to feed the antenna elements $\mathbf{25}_1$ to $\mathbf{25}_8$ with an electromagnetic wave in phase with each other.

However, the lengths e1 to e8 of the end portions 26*a* of the radiating dielectrics 26 increase little by little, thus causing a phase difference corresponding to a difference in the length.

In the planar antenna 20, therefore, the respective intervals a1 to a7 between adjacent antenna elements $\mathbf{25}_1$ to $\mathbf{25}_8$ are set such that they decrease with distance from the one end 23*a* (waveguide 24 side) of the feeding dielectric 23 by the line wavelength of the feeding dielectric 23, and the antenna elements 251 to 258 are fed with the same power completely in phase.

The antenna elements $\mathbf{25}_1$ to $\mathbf{25}_8$ leak a radio wave while transmitting an electromagnetic wave along a line from one end to the other. If, therefore, an amount of leaky is uniform per unit length, the radio wave decreases in amplitude as it travels and thus a completely uniform amplitude distribution cannot be obtained.

In order to obtain a uniform amplitude distribution, the strip width s (the length of the metal strip) in one antenna element, not shown, is increased little by little from the feeding side, and the amount of leaky is increased with distance therefrom.

By doing so, the antenna elements $\mathbf{25}_1$ to $\mathbf{25}_8$ are excited in phase with a uniform amplitude to radiate radio waves with given radiation characteristics.

The planar antenna 20 of the first embodiment described above has the structure wherein the leaky-wave type antenna elements $\mathbf{25}_1$ to $\mathbf{25}_8$, which have perturbations in the image line and decrease in transmission loss, are arranged in parallel with each other. The whole antenna thus improves in aperture efficiency at a low transmission loss.

Further, in the planar antenna 20 of the first embodiment, the feeding section is of an image line type, so that the entire antenna can be very thinned and its design, manufacture and mounting are easy and low in costs. Since, moreover, the metal strips can be formed to exact dimensions by the printing and etching techniques, the radiation characteristics can be uniformed.

Furthermore, in the planar antenna 20 of the first embodiment, the radiation characteristics of the antenna elements can freely be set by the cycle and length of the metal strips, and a complicated radiation characteristic can easily be obtained.

Second Embodiment

In the planar antenna 20 according to the foregoing first embodiment, a waveguide is used as an input section of the feeding section.

Figure 6:
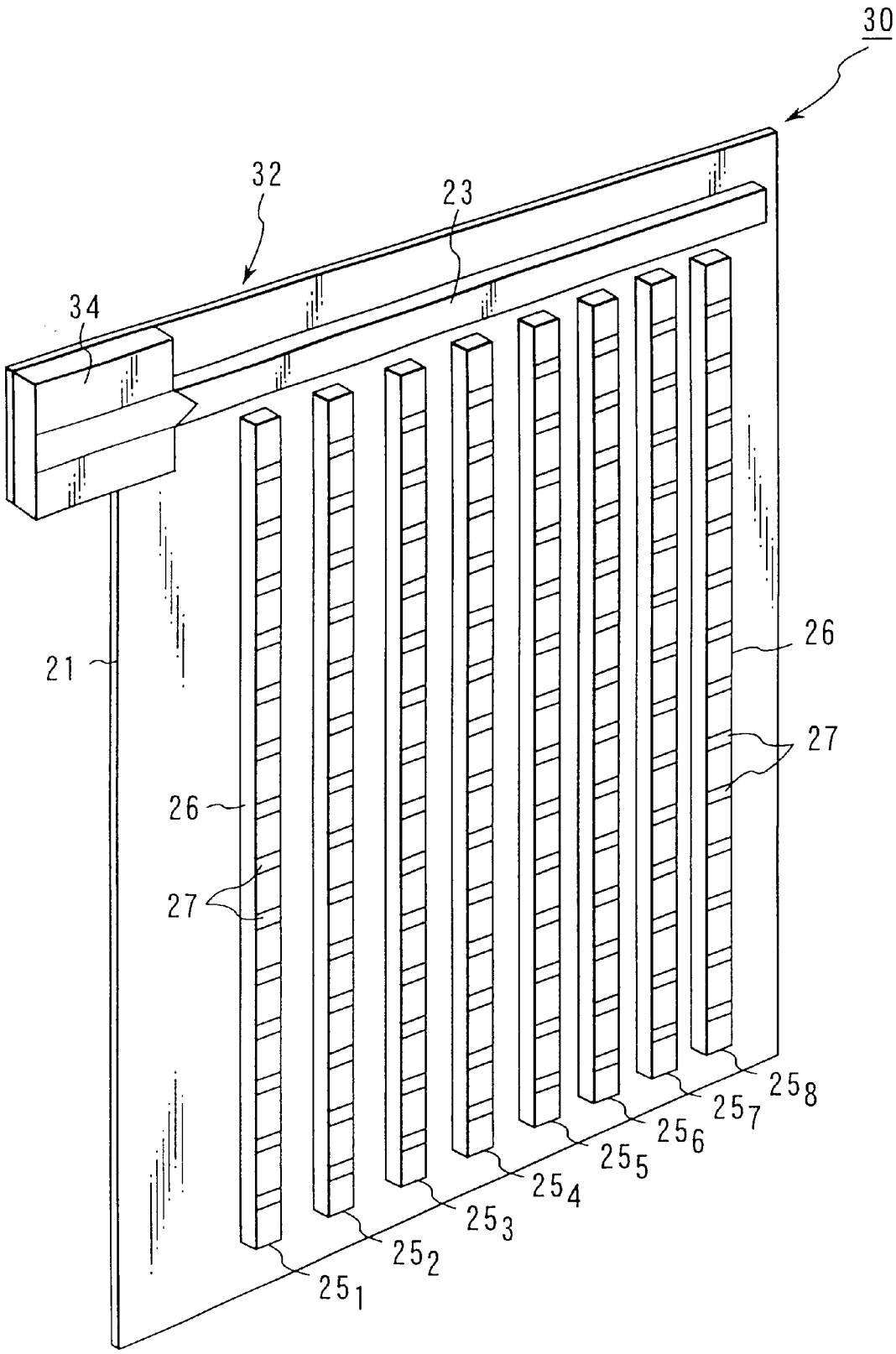
FIG. 6 is a perspective view showing the structure of a planar antenna according to a second embodiment of the present invention.

In contrast, according to a second embodiment as shown in FIG. 6, a microstrip line 34 is employed as an input section of a feeding section 32 of a planar antenna 30.

Instead of the microstrip line 34, the input section can be constituted of a coplanar line.

Third Embodiment

In the planar antenna 20 according to the foregoing first embodiment, the feeding section is constituted of an image line.

Figure 7:
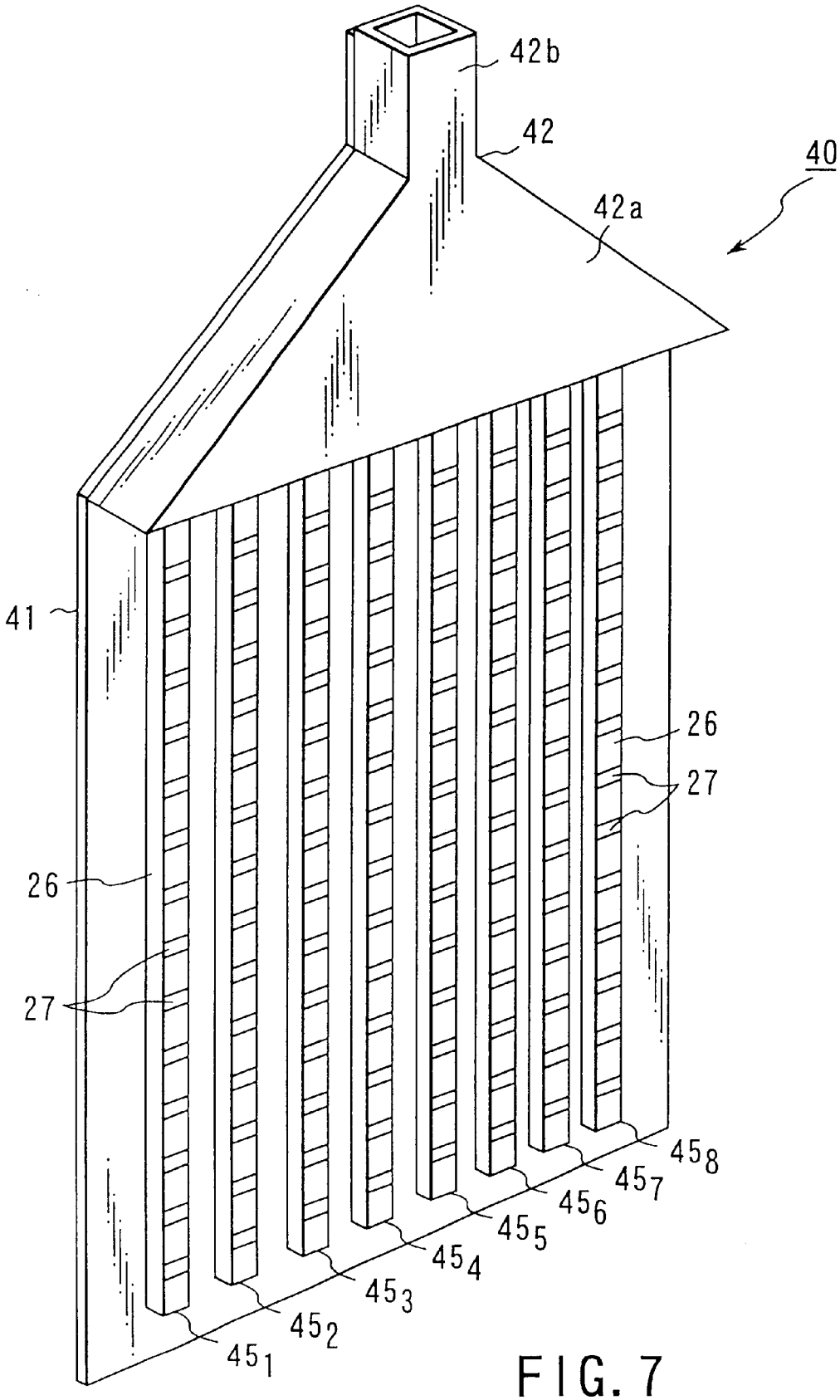
FIG. 7 is a perspective view showing the structure of a planar antenna according to a third embodiment of the present invention.
Figure 8:
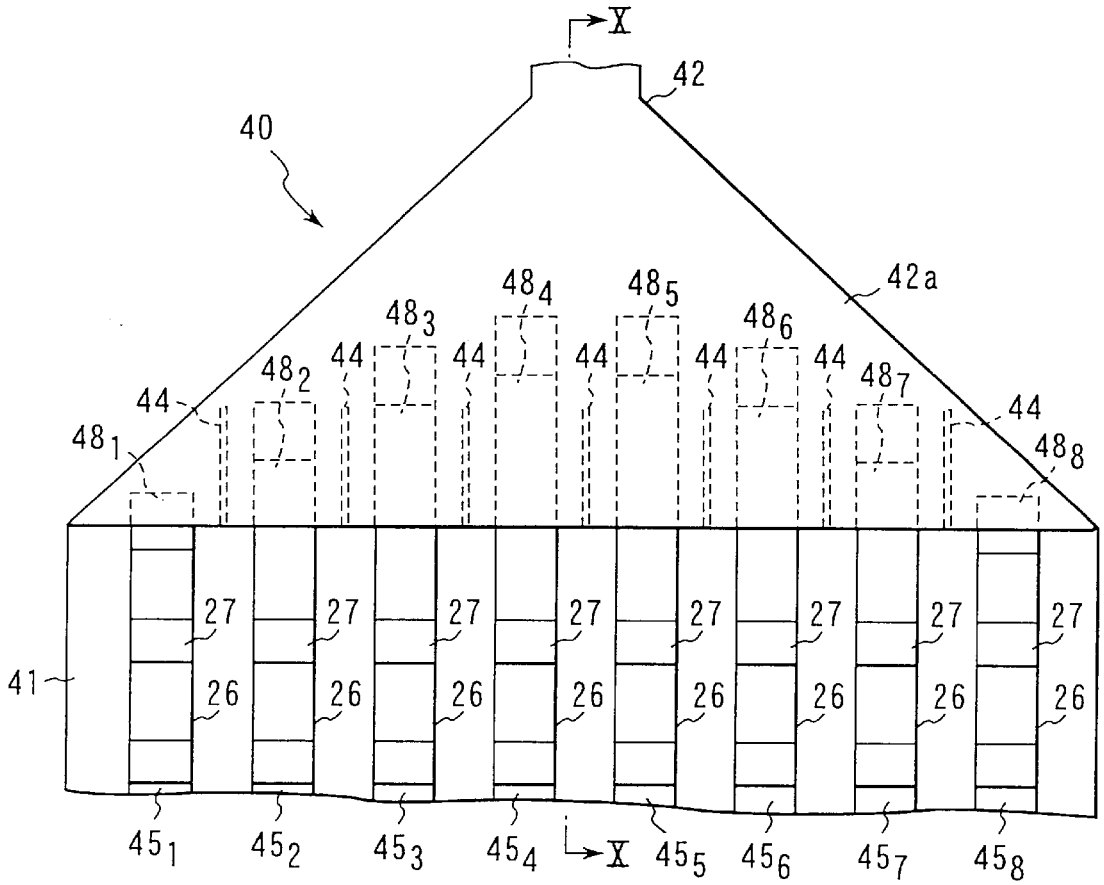
FIG. 8 is an enlarged front view of a major part of the planar antenna shown in FIG. 7.

In contrast, according to a third embodiment of the present invention, an electromagnetic horn is used as illustrated in FIGS. 7 and 8.

More specifically, when the electromagnetic horn is used as a feeding section, a planar antenna 40 shown in FIGS. 7 and 8 can be thinned as a whole using an H-plane (magnetic field) sectoral horn 42 in which the height of a horn section 42*a* is almost equal to that of a waveguide section 42*b*.

The H-plane sectoral horn 42 is so formed that an aperture portion 43 of the horn section 42*a* crosses a radiating dielectric 26 of each of antenna elements, and its bottom portion serves as a ground conductor 41.

Figure 9A:
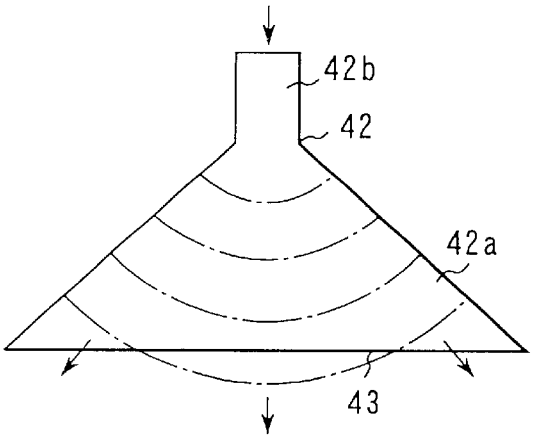
FIGS. 9A and 9B are schematic views for explaining an operation of the major part of the planar antenna shown in FIG. 7.

In the H-plane sectoral horn 42, however, the wavefront (with which a phase coincides) of an electromagnetic wave input to a waveguide portion 42*b* serving as an input section, is changed from a plane wave to a nearly-cylindrical wave as illustrated in FIG. 9A.

Even though one end of each of the antenna elements is arranged in parallel with the edge of the radiating aperture portion 43 of the horn section 42*a*, the phases of electromagnetic waves fed to the antenna elements become non-uniform.

Figure 9B:
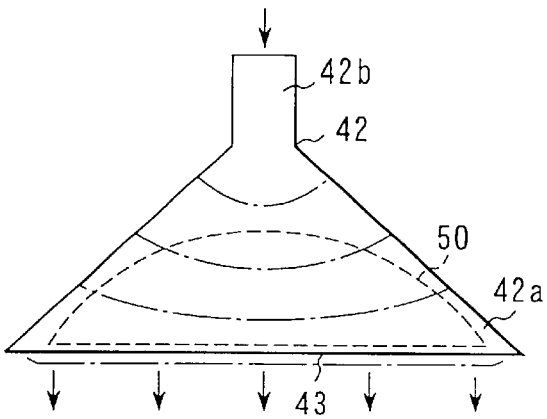

It can thus be thought that, as shown in FIG. 9B, an electromagnetic lens 50 is inserted into the horn section 42*a* and its output wavefront is converted into a plane wave.

The third embodiment focuses attention on the fact that the electromagnetic lens is constituted of a dielectric. As shown in FIG. 8, antenna elements $\mathbf{45}_1$ to $\mathbf{45}_8$ are formed in substantially the same manner as the antenna elements $\mathbf{25}_1$ to $\mathbf{25}_8$ of the first embodiment. The antenna elements $\mathbf{45}_1$ to $\mathbf{45}_8$ include their respective radiating dielectrics 26 having elongated portions $\mathbf{48}_1$ to $\mathbf{48}_8$ at one end. These elongated portions have different lengths corresponding to the thicknesses of portions of the electromagnetic lens 50, thereby adjusting a wavefront and guiding it to the radiating dielectrics 26. The antenna elements $\mathbf{45}_1$ to $\mathbf{45}_8$ are therefore excited in phase with each other.

Figure 10:
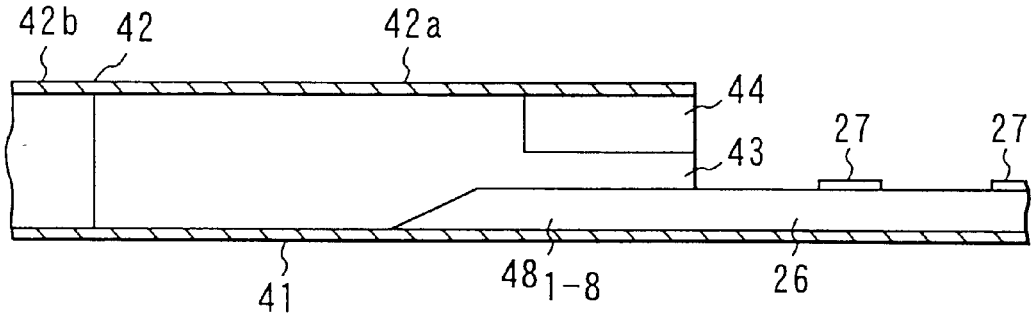
FIG. 10 is a cross-sectional view taken along line X—X of FIG. 8.

Referring to FIG. 10, the ends of the elongated portions $\mathbf{48}_1$ to $\mathbf{48}_8$ are tapered in order to match the H-plane sectoral horn 42.

A plurality of metal plates 44 are attached to the upper edge of the radiating aperture portion 43 of the horn section 42*a* at intervals each corresponding to not more than half of the free-space wavelength so as to interpose the elongated portions $\mathbf{48}_1$ to $\mathbf{48}_8$ of the radiating dielectrics therebetween. The metal plates are parallel with the center line of the horn section 42*a* and perpendicular to the ground conductor 41, and each of the metal plates has a length nearly corresponding to half of the free-space wavelength of the electromagnetic wave.

The metal plates 44 have a function of inhibiting an electromagnetic wave from directly radiating from the horn section 42*a* to the external space to transmit the electromagnetic wave to the elongated portions $\mathbf{48}_1$ to $\mathbf{48}_8$ with efficiency.

Fourth Embodiment

In the planar antenna 40 according to the third embodiment described above, it is assumed that the dielectric constant of the radiating dielectrics 26 constituting the antenna elements $\mathbf{45}_1$ to $\mathbf{45}_8$ is relatively high, and the height of the section of each dielectric is greatly smaller than that of the waveguide.

In contrast, in a planar antenna according to a fourth embodiment, it is assumed that the dielectric constant of radiating dielectrics constituting antenna elements $\mathbf{45}_1$ to $\mathbf{45}_8$ is low and the height of the section of each dielectric is close to that of a waveguide.

Figure 11:
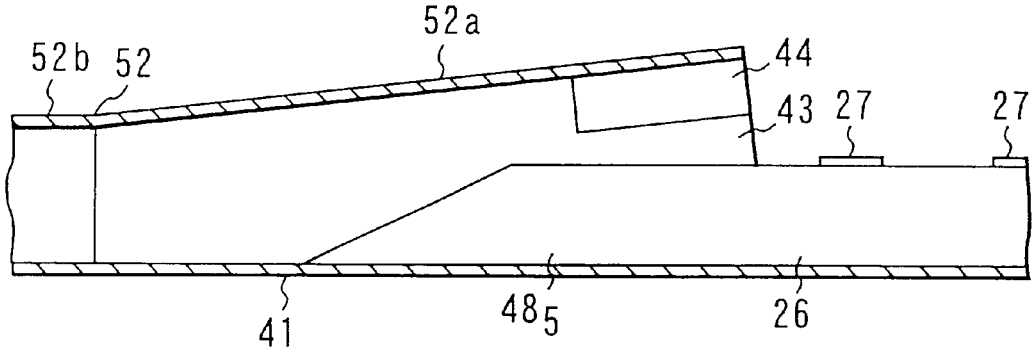
FIG. 11 is a cross-sectional view of a major part showing the structure of a planar antenna according to a fourth embodiment of the present invention.

In other words, an electromagnetic horn 52 is employed in the fourth embodiment as shown in FIG. 11, and its horn section 52*a* continues with a waveguide section 52*b* serving as an input section and opens to an E (electric field) plane.

Fifth Embodiment

In the planar antenna 40 according to the foregoing third embodiment, a cylindrical wave radiating from the center of the H-plane sectoral horn 42 is converted into a plane wave by means of the electromagnetic lens formed of the portions elongated from the ends of the radiating dielectrics.

The radiating center of the H-plane sectoral horn 42 is thus caused to coincide with the focal point of a fixed-focus electromagnetic lens.

As described above, when an electromagnetic lens is formed of an elongated portion of each of the radiating dielectrics, it is applied as a bifocal electromagnetic lens, and a plurality of feeding radiators each having a radiating center on two focal points of the bifocal electromagnetic lens and a line passing through the two focal points or near the line, are arranged, thus obtaining a multibeam antenna.

Figure 12:
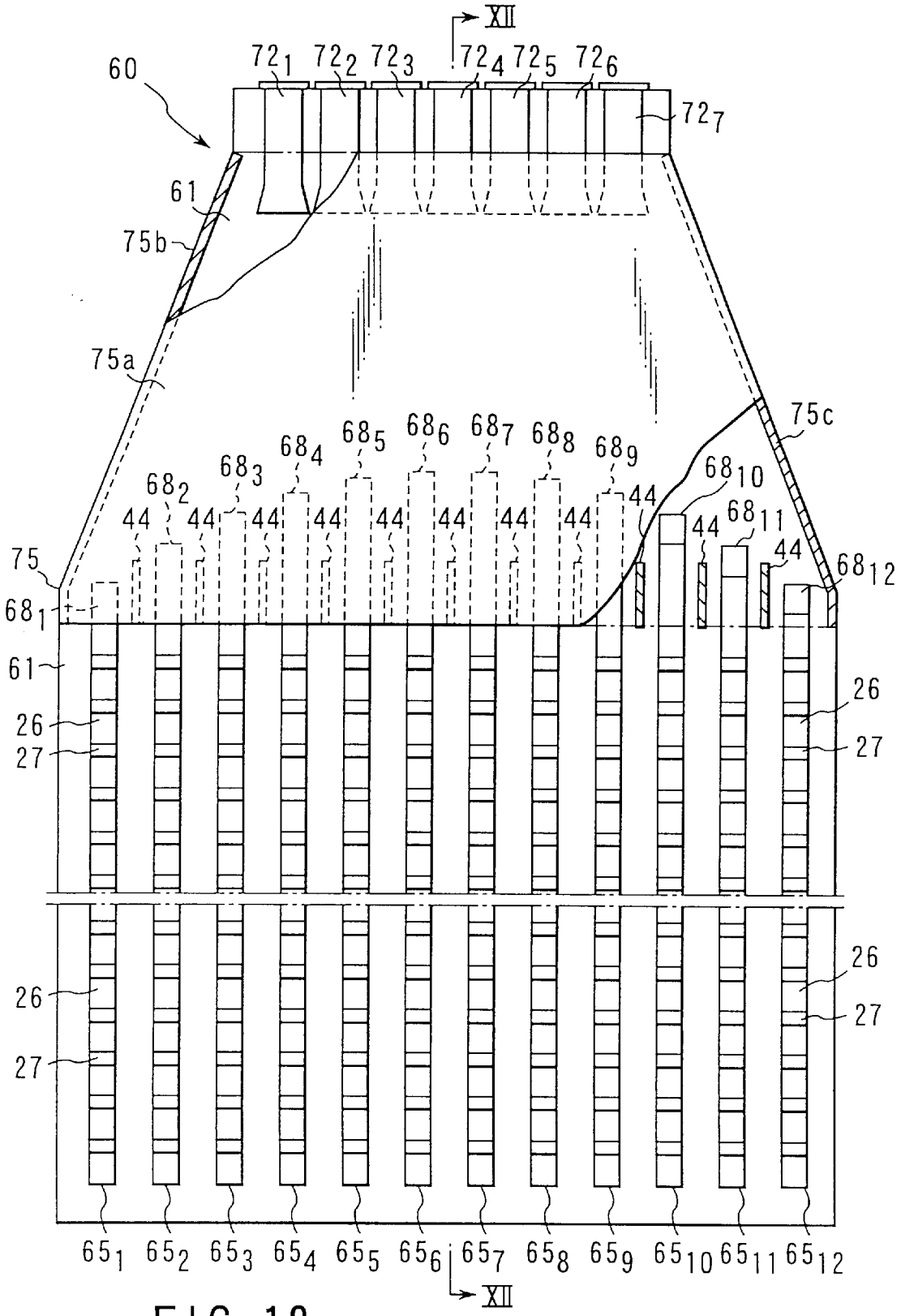
FIG. 12 is a front view showing the structure of a planar antenna according to a fifth embodiment of the present invention.
Figure 13:
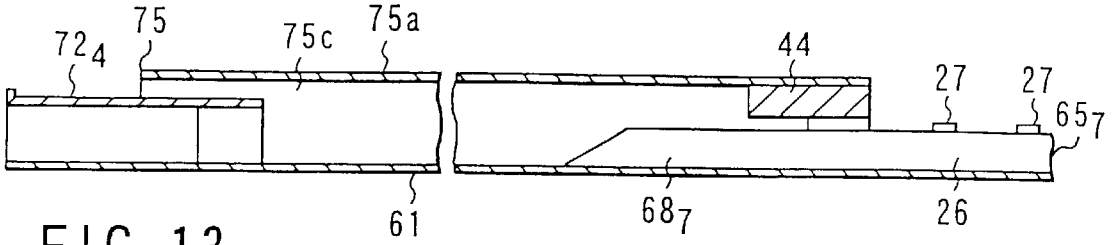
FIG. 13 is an enlarged cross-sectional view taken along line XII—XII of FIG. 12.

In the fifth embodiment, a multibeam planar planner antenna 60 is achieved as illustrated in FIGS. 12 and 13.

Like the foregoing planar antenna 40, the planar antenna 60 includes twelve leaky-wave type antenna elements $\mathbf{65}_1$ to $\mathbf{65}_{12}$. These antenna elements are formed of metal strips 27 serving as perturbations, and the metal strips are arranged at established intervals on the surface of each of a plurality of radiating dielectrics 26 (twelve radiating dielectrics are shown in the Figure but more dielectrics can be used). The radiating dielectrics 26 are arranged in parallel on a ground conductor 61 made of metal.

Elongated portions $\mathbf{68}_1$ to $\mathbf{68}_{12}$ are provided at the ends of the radiating dielectrics 26 of the antenna elements $\mathbf{65}_1$ to $\mathbf{65}_{12}$, and their lengths are set to form a bifocal lens having two focal points.

Figure 14:
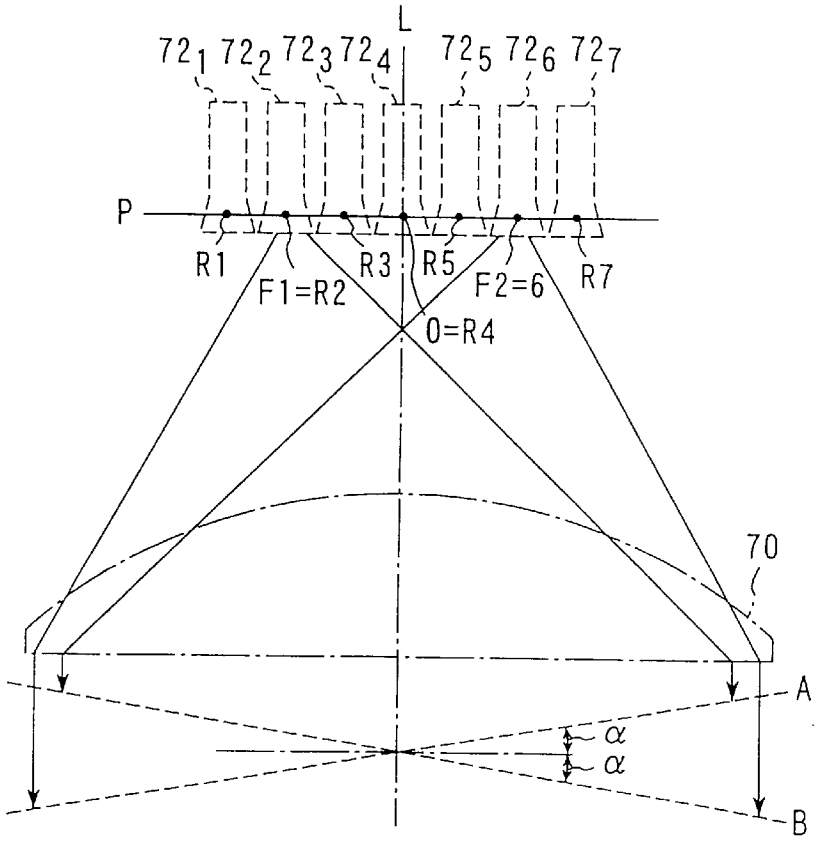
FIG. 14 is a view for explaining a function of a bifocal electromagnetic lens.

By the way, as shown in FIG. 14, a bifocal lens 70 generally has focal points F1 and F2 in positions symmetrical with regard to the center line L of the lens.

A cylindrical wave radiating from the focal point F1 is converted into a plane wave having a wavefront A which is inclined counterclockwise a predetermined angle $\alpha$ toward the plane intersecting the center line L at the angles, and the plane wave is output.

A cylindrical wave radiating from the focal point F2 is converted into a plane wave having a wavefront B which is symmetrical with the surface A and inclined clockwise a predetermined angle a toward the plane intersecting the center line L of the lens, and the plane wave is output.

The output wavefronts corresponding to the cylindrical waves radiating from points excluding the focal points F1 and F2 on a straight line P passing through the focal points F1 and F2, are not complete planes.

Figure 15:
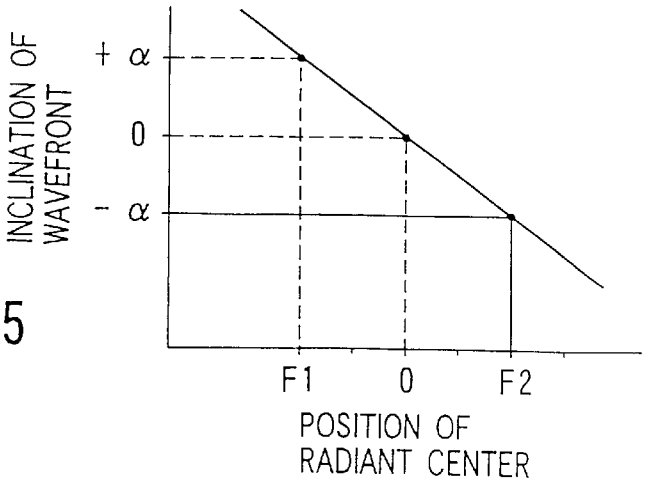
FIG. 15 is a diagram showing an inclination of the wavefront to the center of radiation.

As is seen from the schematic characteristic diagram of FIG. 15, the inclination of the wavefront is varied monotonously between the focal points F1 and F2 and in the range close to the focal points F1 and F2 (the characteristics shown in FIG. 15 are directed to a tendency and do not always correspond to the actual ones).

In FIG. 15, "0" of the horizontal axis is a point of intersection between the lens center line L and the straight line P at right angles, and the actual characteristics are symmetrical with respect to position "0" in view of the symmetry of the lens.

Consequently, a plurality of radiators having a cylindrical-wave radiating center on a line passing through the two focal points F1 and F2 and in a range close to the line and not far from the focal points F1 and F2, are arranged so that the inclinations of the surfaces of waves output from the lens are to vary from radiator to radiator.

Due to a difference in the inclinations of the surfaces of the output waves, the plurality of antenna elements $\mathbf{65}_1$ to $\mathbf{65}_{12}$ can be excited by electromagnetic waves whose phases are shifted from given amount.

The planar antenna 60 is thus applied as a multibeam one using the above principle.

In the planar antenna 60 as shown in FIG. 12, a bifocal electromagnetic lens, which is equivalent to the above electromagnetic lens 70, can be formed of the elongated portions $\mathbf{68}_1$ to $\mathbf{68}_{12}$ of the antenna elements $\mathbf{65}_1$ to $\mathbf{65}_{12}$.

In the planar antenna 60, as shown in FIG. 14, seven feeding radiators $\mathbf{72}_1$ to $\mathbf{72}_7$ have their radiating centers in seven points R1 to R7 aligned with a line passing through the focal points F1 and F2. The feeding radiators are arranged at intervals corresponding to equal parts (four parts in this example) into which the interval between the focal points F1 and F2 is divided. The feeding radiators are also provided in parallel such that their radiating faces are directed to the elongated portions $\mathbf{68}_1$ to $\mathbf{68}_{12}$ of the antenna elements $\mathbf{65}_1$ to $\mathbf{65}_{12}$.

In this case, the feeding radiators $\mathbf{72}_1$ to $\mathbf{72}_7$ are of a waveguide type in which an electromagnetic wave is input through one end and radiates from the other end. The other end expands toward the bifocal electromagnetic lens formed of the elongated portions $\mathbf{68}_1$ to $\mathbf{68}_{12}$ of the antenna elements $\mathbf{65}_1$ to $\mathbf{65}_{12}$.

The inner-wall surfaces of the feeding radiators $\mathbf{72}_1$ to $\mathbf{72}_7$ alongside the ground conductor 61 corresponds to the surface of the ground conductor 61.

A substantially trapezoidal top plate 75*a* of a guide 75 formed of a metal plate covers a range from above the elongated portions $\mathbf{68}_1$ to $\mathbf{68}_{12}$ of the antenna elements $\mathbf{65}_1$ to $\mathbf{65}_{12}$ to above the end portions of the feeding radiators $\mathbf{72}_1$ to $\mathbf{72}_7$.

The top plate 75*a* of the guide 75 is arranged opposite to and in parallel with the ground conductor 61, and side plates 75*b* and 75*c* are provided on their respective sides of the top plate 75*a*.

The lower edges of the side plates 75*b* and 75*c* are electrically connected to the top of the ground conductor 61.

A range from the end portions of the feeding radiators $\mathbf{72}_1$ to $\mathbf{72}_7$ to the elongated portions $\mathbf{68}_1$ to $\mathbf{68}_{12}$ of the antenna elements $\mathbf{65}_1$ to $\mathbf{65}_{12}$ is interposed in parallel between the top plate 75*a* of the guide 75 and the ground conductor 61 to convert electromagnetic waves radiating from the feeding radiators $\mathbf{72}_1$ to $\mathbf{72}_7$ into cylindrical waves and transmit them to the elongated portions $\mathbf{68}_1$ to $\mathbf{68}_{12}$ of the antenna elements $\mathbf{65}_1$ to $\mathbf{65}_{12}$ with efficiency.

The above metal plates 44 are arranged at the edge and on the inner surface of the upper plate 75*a* of the guide 75 alongside the antenna elements so as to interpose the radiating dielectrics therebetween. The metal plates 44 are also arranged at intervals each corresponding to not more than half of the free-space wavelength of an electromagnetic wave, thus preventing an electromagnetic wave from leaking from a gap between the upper plate 75*a* and each of the elongated portions $\mathbf{68}_1$ to $\mathbf{68}_{12}$ of the antenna elements $\mathbf{65}_1$ to $\mathbf{65}_{12}$.

In the planar antenna 60 so constituted, the feeding radiators $\mathbf{72}_1$ to $\mathbf{72}_7$ have different radiating beam directions.

An electromagnetic wave radiating from the middle feeding radiator $\mathbf{72}_4$ is converted into a cylindrical wave between the guide 75 and ground conductor 61, and the cylindrical wave is fed to the antenna elements $\mathbf{65}_1$ to $\mathbf{65}_{12}$ while its wavefront is nearly parallel with a plane intersecting the center line of each of the elongated portions $\mathbf{68}_1$ to $\mathbf{68}_{12}$ at right angles by the lens function of the elongated portions.

Figure 16:
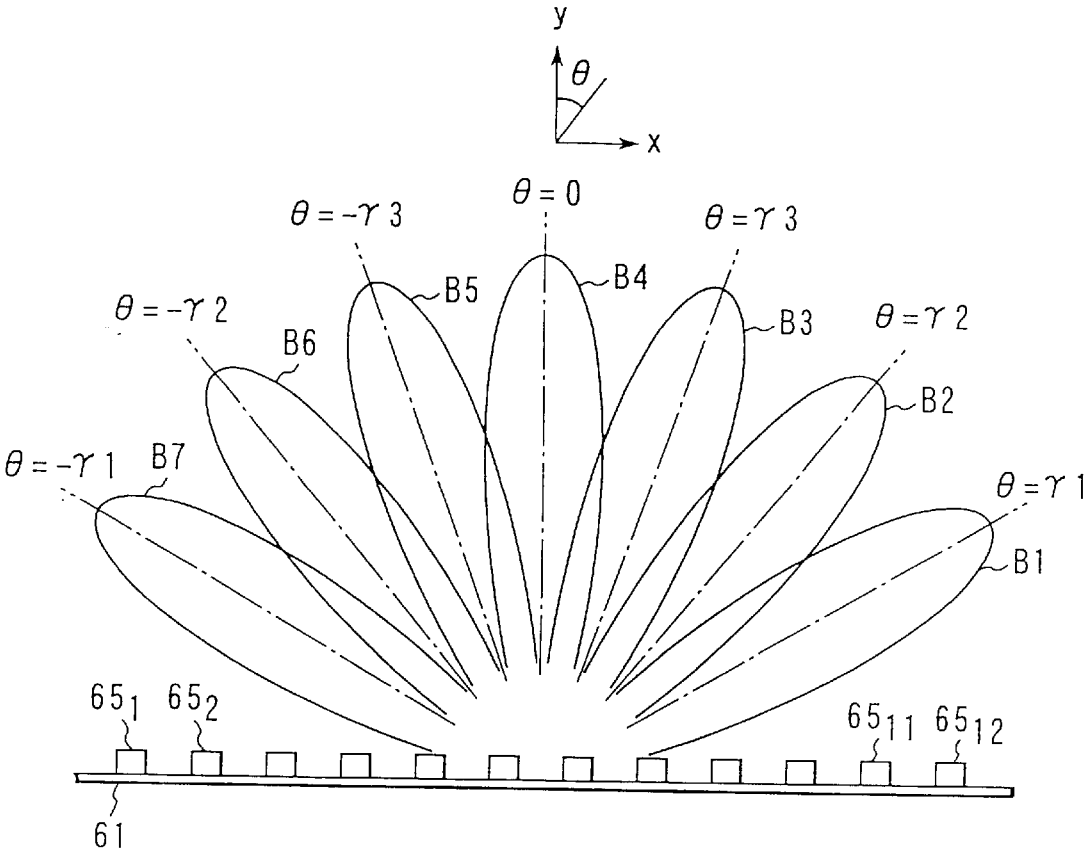
FIG. 16 is a diagram illustrating beam characteristics of the planar antenna shown in FIG. 12.

The antenna elements $\mathbf{65}_1$ to $\mathbf{65}_{12}$ are therefore excited almost in phase. As shown in FIG. 16, they have a radiating beam characteristic B4 along the y-axis on the x-y plane where the direction of arrangement of the antenna elements $\mathbf{65}_1$ to $\mathbf{65}_{12}$ is the x-axis and the direction perpendicular to the surface of the ground conductor 61 is the y-axis.

An electromagnetic wave radiating from the feeding radiator $\mathbf{72}_3$ is fed to the antenna elements $\mathbf{65}_1$ to $\mathbf{65}_{12}$ while its wavefront is nearly parallel with a plane inclined counterclockwise (in FIG. 14) from the plane intersecting the lens center line at right angles.

The antenna elements $\mathbf{65}_1$ to $\mathbf{65}_{12}$ are excited with an almost fixed phase difference in such a manner that the excitation phase of the endmost antenna element $\mathbf{65}_1$ advances from that of its adjacent antenna element $\mathbf{65}_2$ by a phase corresponding to an inclination of the waveform and the excitation phase of the antenna element $\mathbf{65}_2$ advances from that of its adjacent antenna element $\mathbf{65}_3$ by almost the same phase. A radiating beam characteristic B3 is therefore obtained in which a beam direction is inclined a predetermined angle of $\gamma 3$ toward the antenna element $\mathbf{65}_{12}$ whose phase is delayed with respect to the y-axis.

Similarly, an electromagnetic wave radiating from the focal point F1 of the feeding radiator $\mathbf{72}_2$ is fed to the antenna elements $\mathbf{65}_1$ to $\mathbf{65}_{12}$ while its wavefront is parallel with a plane inclined counterclockwise (in FIG. 14) from the plane intersecting the lens center line at right angles more greatly than in the case of the feeding radiator $\mathbf{72}_3$. The antenna elements $\mathbf{65}_1$ to $\mathbf{65}_{12}$ are therefore excited with a wider phase difference, and the feeding radiator $\mathbf{72}_2$ has a radiating beam characteristic B2 in which a beam direction is inclined an angle of $\gamma 2$, which is larger than $\gamma 3$, toward the antenna element $\mathbf{65}_{12}$ whose phase is delayed with respect to the y-axis.

Further, an electromagnetic wave radiating from the feeding radiator $\mathbf{72}_1$ is fed to the antenna elements $\mathbf{65}_1$ to $\mathbf{65}_{12}$ while its wavefront is nearly parallel with a plane inclined counterclockwise (in FIG. 14) from the plane intersecting the lens center line at right angles more greatly than in the case of the feeding radiator $\mathbf{72}_3$. The antenna elements $\mathbf{65}_1$ to $\mathbf{65}_{12}$ are therefore excited with a wider phase difference, and the feeding radiator $\mathbf{72}_1$ has a radiating beam characteristic B1 in which a beam direction is inclined an angle of $\gamma 1$, which is larger than $\gamma 2$, toward the antenna element $\mathbf{65}_{12}$ whose phase is delayed with respect to the y-axis.

Since the feeding radiators $\mathbf{72}_5$ to $\mathbf{72}_7$ are arranged symmetrically with the feeding radiators $\mathbf{72}_3$ to $\mathbf{72}_1$ with regard to the lens center line, the feeding radiator $\mathbf{72}_5$ has a beam characteristic B5 which is inclined an angle of $\gamma 3$ toward the antenna element $\mathbf{65}_1$ whose phase is delayed with respect to the y-axis, the feeding radiator $\mathbf{72}_6$ has a beam characteristic B6 which is inclined an angle of $\gamma 2$ toward the antenna element $\mathbf{65}_1$ whose phase is delayed with respect to the y-axis, and the feeding radiator $\mathbf{72}_7$ has a beam characteristic B7 which is inclined an angle of $\gamma 1$ toward the antenna element $\mathbf{65}_1$ whose phase is delayed with respect to the y-axis.

In the planar antenna 60 according to the fifth embodiment described above, an electromagnetic wave radiating from each of the feeding radiators is fed to the plurality of radiating dielectrics with a phase difference corresponding to the center of radiation of the electromagnetic wave.

The planar antenna is thus directed to a multibeam antenna wherein a plurality of feeding radiators radiate narrow, high-gain beams in different directions.

The direction in which the planar antenna 60 according to the fifth embodiment can be mounted, is limited. Even when a radio wave has to be radiated (or received) in a direction other than the limited direction, highly efficient communications can be performed by selecting a feeding radiator adapted to the direction.

As described above, the electromagnetic waves radiating from the feeding radiators $72_2$ and $72_6$ having their radiation centers on the focal points F1 and F2 of the bifocal electromagnetic lens are converted into complete plane waves, and the plane waves are fed to the antenna elements $65_1$ to $65_{12}$ with an almost uniform phase difference, whereas the electromagnetic waves radiating from the other feeding radiators are not converted into complete plane waves and there occur variations in phase difference between the plane waves.

Figure 17:
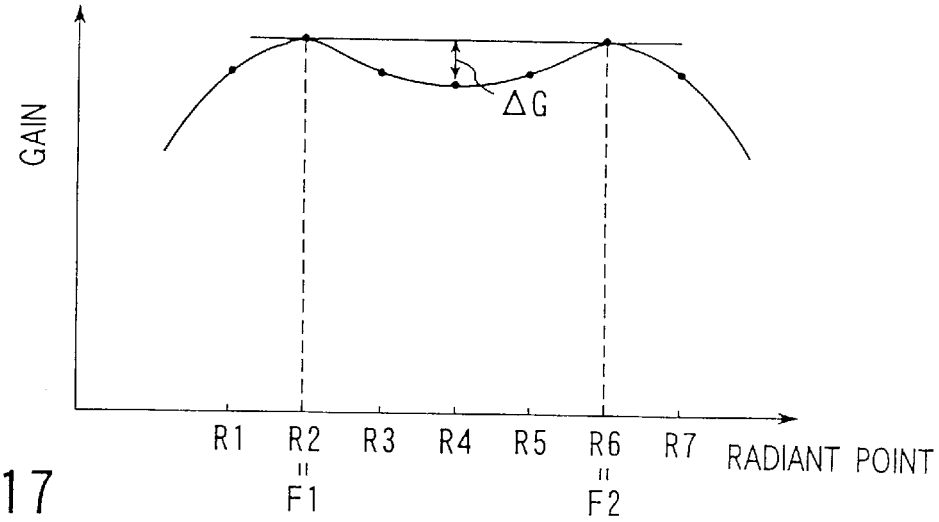
FIG. 17 is a graph showing variations in gain with the center of radiation.

For this reason, as illustrated in FIG. 17, the antenna gain to the feeding radiators other than the feeding radiators $72_2$ and $72_6$ is lower than that to the radiators $72_2$ and $72_6$. The maximum gain difference ΔG does not become too large if the radiation centers of the feeding radiators are located near the two focal points of the bifocal electromagnetic lens and on the line passing through these focal points or near this line, thus obtaining a multibeam antenna having an almost uniform gain and directivity.

In the planar antenna 60, the guide 75 and the plurality of feeding radiators $72_1$ and $72_7$ are formed independently. However, the upper plate 75*a* of the guide 75 can be used as an upper wall surface of the feeding radiators $72_1$ and $72_7$ (the wall surface opposed to the ground conductor 61).

Sixth Embodiment

Figure 18:
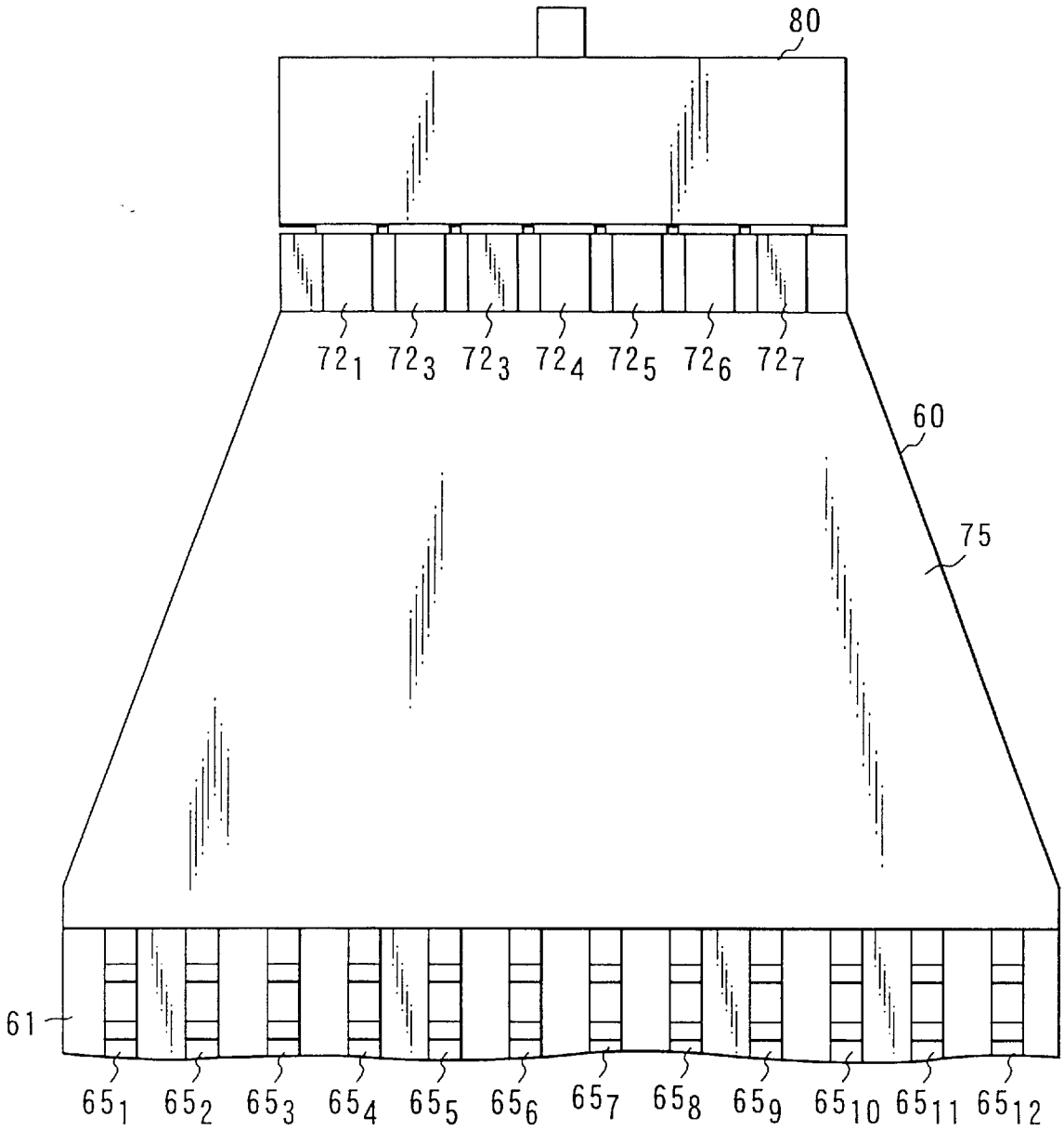
FIG. 18 is a front view showing a major part of the structure of a planar antenna according to a sixth embodiment of the present invention.

FIG. 18 illustrates a major part of a sixth embodiment.

In the sixth embodiment, as shown in FIG. 18, a planar antenna 60 having a plurality of beam characteristics is provided with a selector circuit 80 for selectively making some of a plurality of feeding radiators $72_1$ and $72_7$ usable.

The selector circuit is controlled by a controller, not shown, to select the plurality of feeding radiators $72_1$ and $72_7$ in order, thus allowing an electronic beam scan.

Conventionally there is a waveguide selector as the selector circuit 80 for changing some of waveguide type feeding radiators into a usable state. The waveguide selector has a waveguide in which a ferrite switch and a semiconductor switch are mounted.

An electronic beam scan can be achieved by selecting the feeding radiators in response to a control signal from the controller using the waveguide selector.

If, however, the prior art waveguide selector is so constituted that a ferrite switch and a semiconductor switch are mounted in a waveguide, the antenna is complicated in structure and increased in size and its productivity is low. It is thus difficult to use for a car-mounted radar requesting miniaturization and low costs.

Seventh Embodiment

Figure 19:
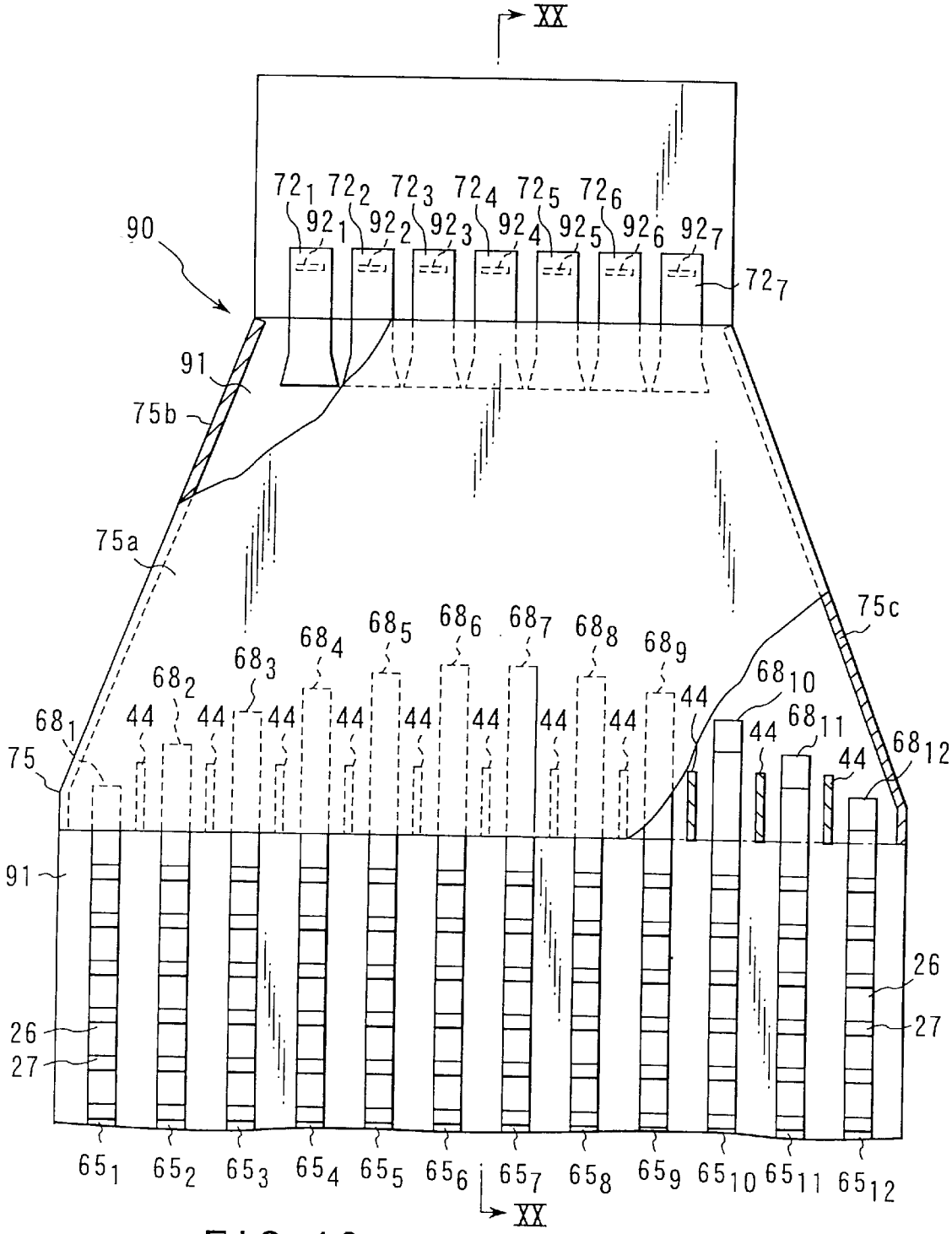
FIG. 19 is a front view of a major part of the structure of a beam scanning type planar antenna according to a seventh embodiment of the present invention.
Figure 20:
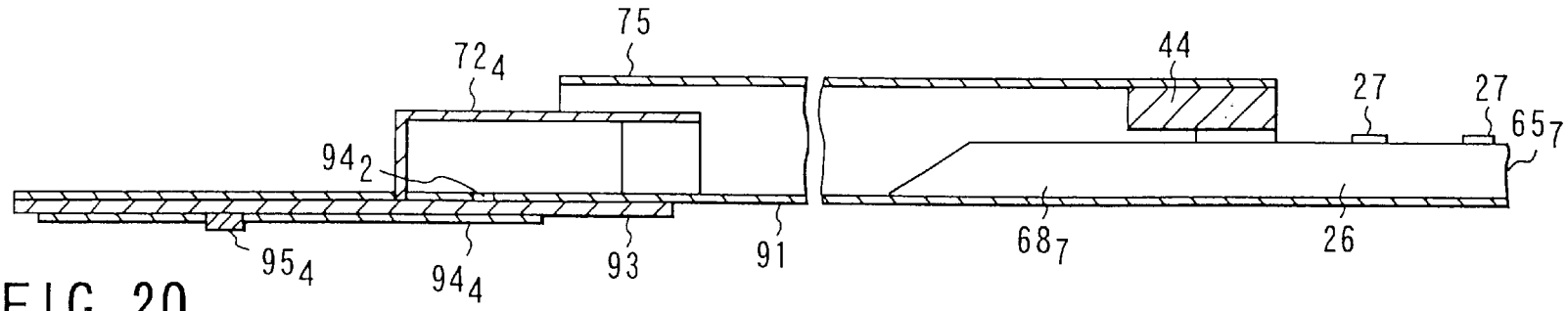
FIG. 20 is an enlarged cross-sectional view taken along line XX—XX of FIG. 19.

FIGS. 19 and 20 illustrate a beam scan type planar antenna 90 according to a seventh embodiment which is assembled in view of the above point.

In the planar antenna 90, one end (opposite to the radiation face) of each of feeding radiators $72_1$ and $72_7$ of the foregoing planar antenna 60 is closed, and coupling slots $92_1$ to $92_7$ are provided on their respective portions of a ground conductor 91 corresponding to the inner walls of the feeding radiators $72_1$ and $72_7$ in a direction perpendicular to the longitudinal direction of the feeding radiators $72_1$ and $72_7$.

In the planar antenna 90, a dielectric substrate 93 is mounted on the back of the ground conductor 91 in positions corresponding to the feeding radiators $72_1$ and $72_7$, and a selector circuit 80' is formed on the dielectric substrate 93.

Figure 21:
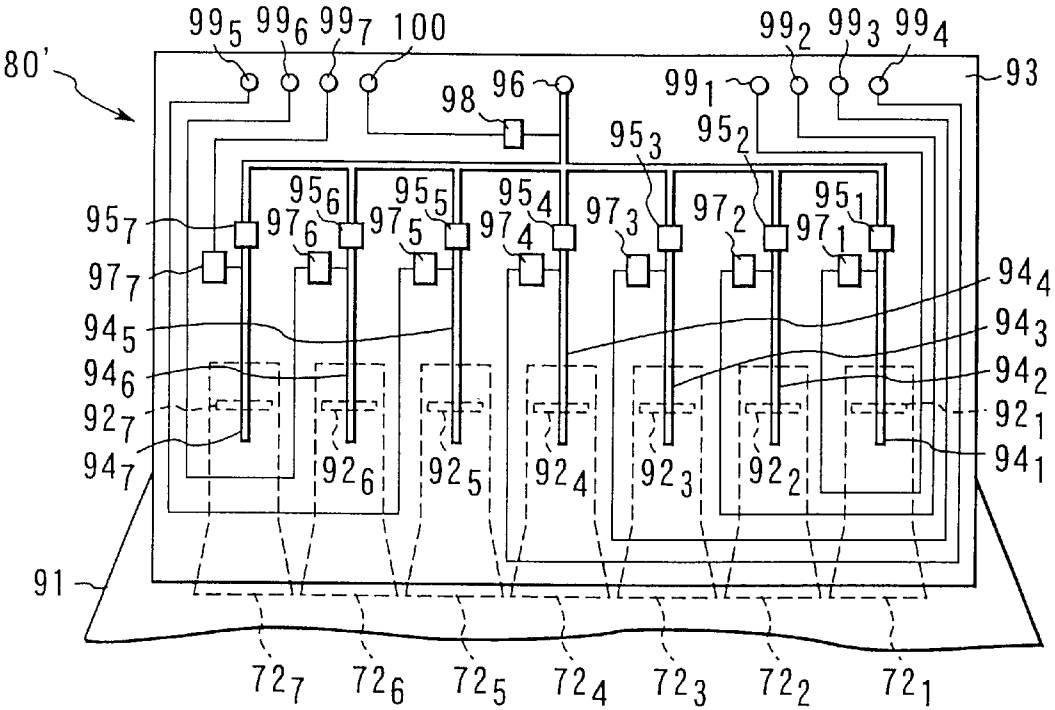
FIG. 21 is an enlarged rear view of a major part of the planar antenna shown in FIG. 19.

In other words, as shown in FIG. 21, probes $94_1$ to $94_7$ are formed in parallel on the dielectric substrate 93, and one end of each of the probes intersects the coupling slots $92_1$ to $92_7$ of the feeding radiators $72_1$ and $72_7$.

The other ends of the probes $94_1$ to $94_7$ are each connected to its corresponding one electrode of each of signal switching diodes (beam lead type and chip type PIN diodes) $95_1$ to $95_7$, while the other electrodes of the diodes $95_1$ to $95_7$ are connected in common to a transmit/receive terminal 96.

The polarity of the diodes $95_1$ to $95_7$ is a cathode on the probe side, while it is an anode on the transmit/receive terminal side.

Low-pass filters $97_1$ to $97_7$ and 98 are connected between the electrodes of the diodes $95_1$ to $95_7$ and transmit/receive terminal 96 and the bias terminals $99_1$ to $99_7$ and 100 formed on the dielectric substrate 93, respectively. These filters transmit a direct current and prevent a high frequency (a millimeter wave in this case) from being transmitted from one electrode of each of the diodes $95_1$ to $95_7$ and the transmit/receive terminal 96 to the bias terminals $99_1$ to $99_7$ and 100.

The low-pass filters $97_1$ to $97_7$ and 98 can be of an LC type constituted of coils inserted in series between the electrodes of the diodes and the bias terminals and capacitors connected between the earth and the terminals of the coils alongside the bias terminals, an RC type constituted of resistors inserted in series between the electrodes of the diodes and the bias terminals and capacitors connected between the earth and the terminals of the resistors alongside the bias terminals, or a multistage circuit of the RC or LC type.

In the planar antenna 90 having such a selector circuit 80', a given voltage V1 is applied from the controller, not shown, to the common bias terminal 100, a voltage V2 lower than the voltage V1 is applied to the bias terminal $99_1$, and a voltage not lower than the voltage V1 is applied to the other bias terminals $99_2$ to $99_7$. Thus, only the diode $95_1$ is turned on.

The electromagnetic wave input to the transmit/receive terminal 96 in this state is transmitted from the diode $95_1$ to the probe $94_1$ then transmitted to the feeding radiator $72_1$ through the coupling slot $92_1$, and fed to the antenna elements $65_1$ to $65_{12}$.

For this reason, the planar antenna 90 radiates an electromagnetic wave with the beam characteristic B1 shown in FIG. 16.

If a voltage V2 lower than the voltage V1 is applied to the bias terminal $99_2$ and a voltage not lower than the voltage V1 is applied to the bias terminals other than the bias terminals $99_2$ and 100, only the diode $95_2$ is turned on.

The electromagnetic wave input to the transmit/receive terminal 96 in this state is transmitted to the feeding radiator $72_1$ through the probe $94_2$ and coupling slot $92_2$ and then fed to the antenna elements $65_1$ to $65_{12}$. The planar 90 radiates an electromagnetic wave radiates with the beam characteristic B2 shown in FIG. 16.

Similarly the diodes $95_3$ to $95_7$ are turned on sequentially and selectively and thus the beam directions of the antenna can be scanned from B1 to B7 in FIG. 16.

When the polarities of the diodes $95_1$ to $95_7$ are reversed, or when the polarities are set to an anode on the probe side and they are set to a cathode on the transmit/receive terminal 96 side, a predetermined voltage V1 is applied to the common bias terminal 100 from the controller, a voltage V2 higher than the voltage V1 is applied to one of the bias terminals $99_1$ to $99_7$ corresponding to a diode which is to be turned on, and a voltage not higher than the voltage V1 is applied to the other bias terminals $99_2$ to $99_7$.

The beam scanning order is freely determined. The scanning is performed not only in the above order, B1→B2→B3→B4→B5→B6→B7, but also it can be done with alternate beams such as B1→B3→B5→B7→B2→B4→B6 or outward from the center such as B4→(B3, B5)→(B2, B6)→(B1, B7).

Since, in the planar antenna 90, the feeding radiator $72_1$ and $72_7$ are selected in order by the selector circuit to scan with the beams, the antenna can be miniaturized much more greatly as compared with a system for switching a plurality of antennas having different beam directions by means of a switch. Further, the antenna 90 requires neither a variable phase shifter nor a synthesizer and thus its configuration is very simplified.

As described above, an electromagnetic wave can be input to the back of the radiating dielectric from the probe formed on the dielectric substrate through the coupling slot and the probe is selected by the diode. Therefore, the selector circuit can be thinned and simplified in configuration, and the antenna is increased in mass production and is the most suitable for a small car-mounted radar manufactured in low costs.

Figure 22:
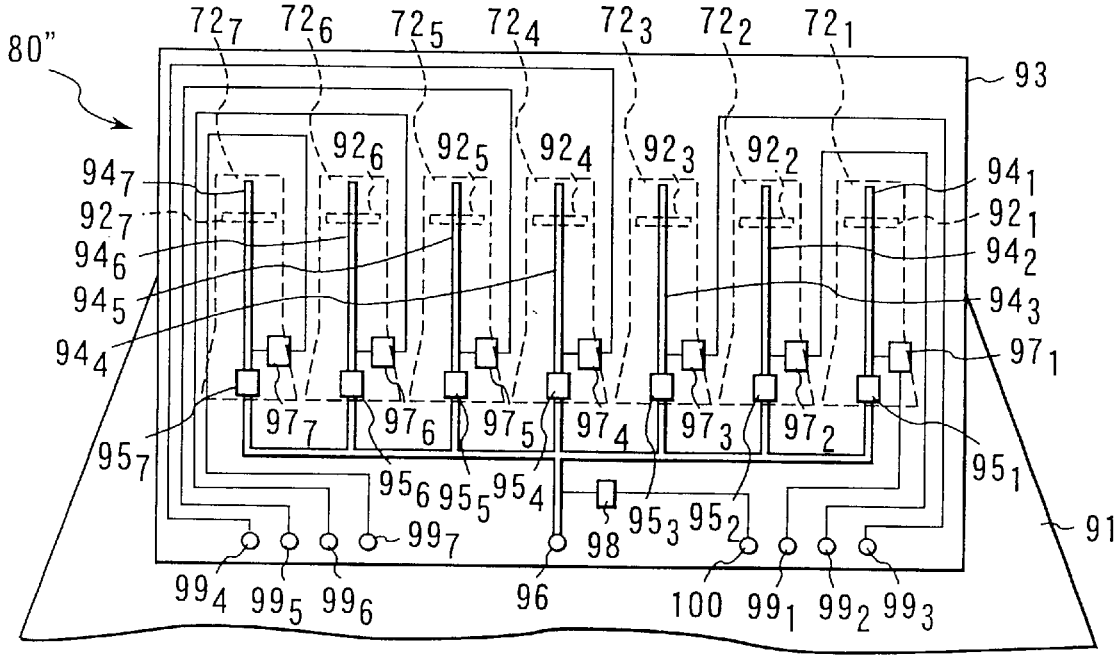
FIG. 22 is a view showing a modification to the arrangement of a selector circuit shown in FIG. 21.

In the selector switch 80' of the planar antenna 90, the probes $94_1$ to $94_7$ extend in the direction opposite to the radiating faces of the feeding radiators $72_1$ and $72_7$ to be connected to their respective diodes $95_1$ to $95_7$. However, as in a selector circuit 80" shown in FIG. 22, the probes $94_1$ to $94_7$ can extend toward the radiating faces of the feeding radiators $72_1$ and $72_7$ to be connected to their respective diodes $95_1$ to $95_7$.

With the above circuit arrangement, the dielectric substrate 93 can be mounted near the antenna elements, and the overall antenna can be compacted and miniaturized further.

A selector element in a usable radio-frequency band (RF band) can be employed as the above selector circuit 80. However, an insertion loss is generally increased in the frequency band corresponding to a millimeter wave. It is thus effective to connect transmit/receive modules RM1 to RM7 and TM1 to TM7 including a frequency converter to their respective probes $94_1$ to $94_7$ each serving as a beam terminal and switch them in an intermediate-frequency (IF) band, as shown in FIGS. 25 and 26.

Figure 25:
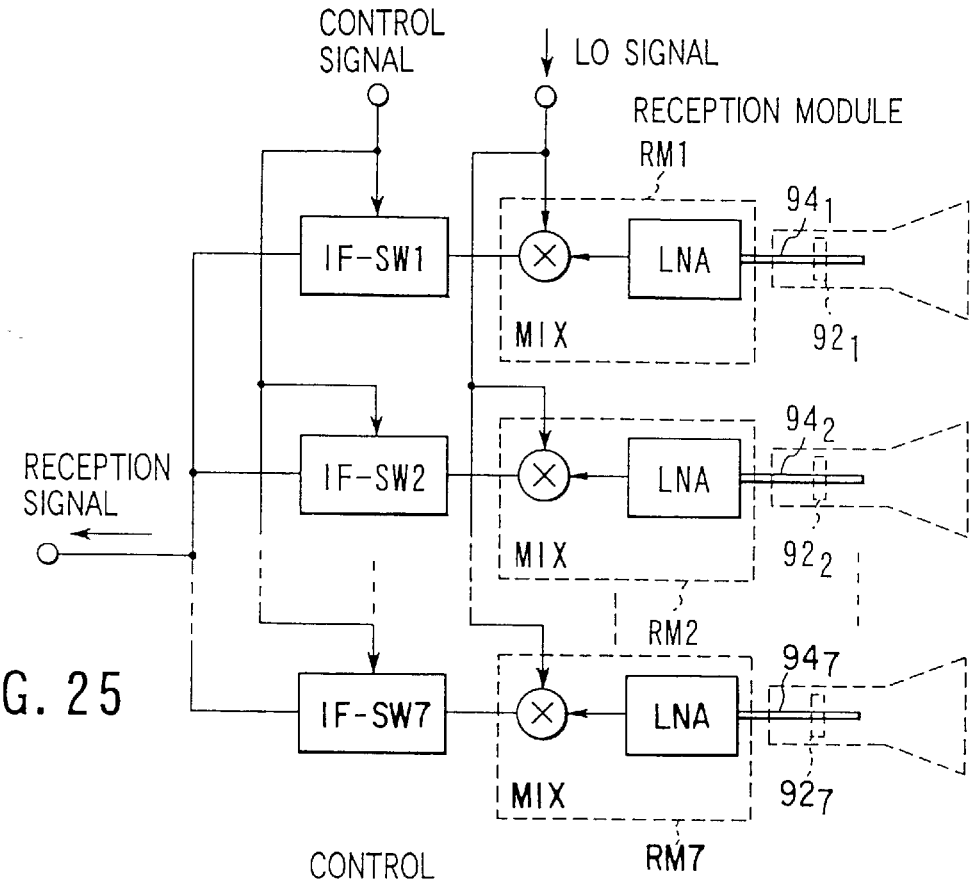
FIG. 25 is a diagram showing a receiving module used as a modification to the selector circuit shown in FIG. 21.

As shown in FIG. 25, the input sides of low-noise amplifiers LNA of receiving modules RM1 to RM7 each constituted of a low-noise amplifier LNA and a mixer MIX, are connected to their respective probes $94_1$ to $94_7$. The mixers MIX are supplied with a local oscillation (LO) signal from an external terminal. Intermediate-frequency-band (IF-band) switching circuits IF-SW1 to IF-SW7 are connected to their ago respective output sides of the mixers MIX and selected in response to a control signal from an external terminal.

The radio waves received from the plurality of probes $94_1$ to $94_7$ are therefore output as reception signals through the receiving modules RM1 to RM7 and the IF-band switching circuits IF-SW1 to IF-SW7 selected in response to a control signal from the external terminal.

Figure 26:
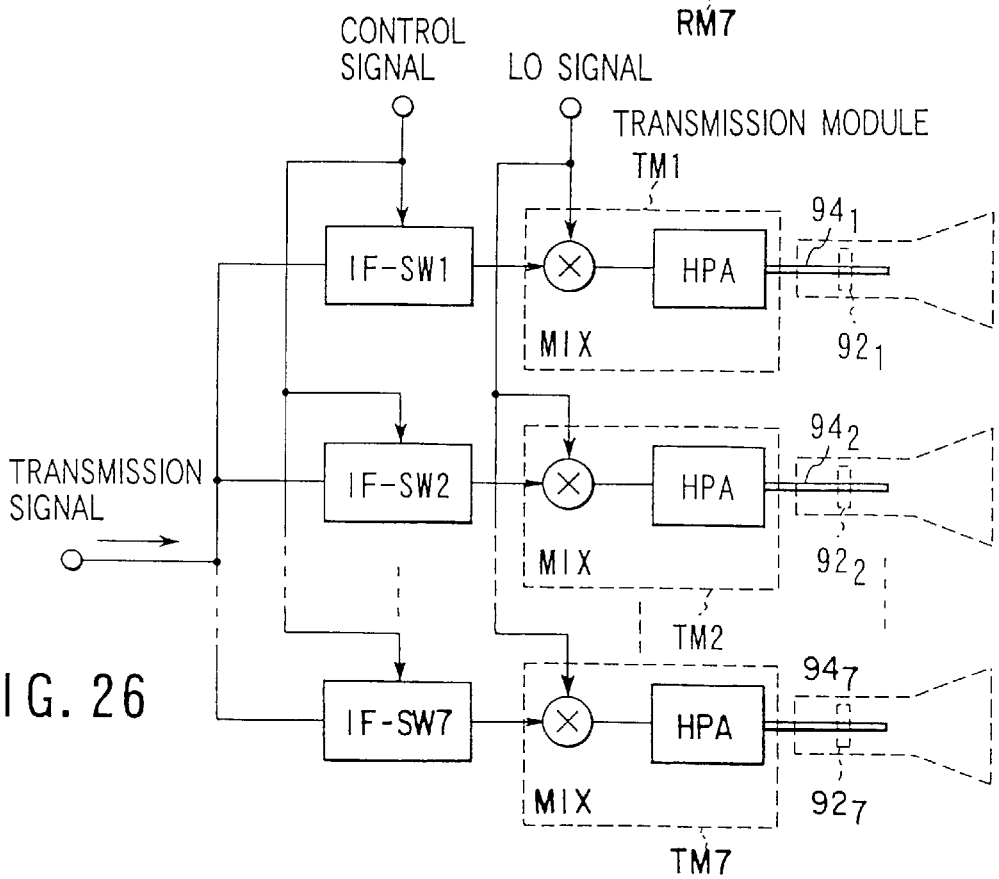
FIG. 26 is a diagram showing a transmitting module used as a modification to the selector circuit shown in FIG. 21.

As shown in FIG. 26, the output sides of power amplifiers HPA of transmitting modules TM1 to TM7 each constituted of a power amplifier HPA and a mixer MIX, are connected to the plurality of probes $94_1$ to $94_7$, respectively. The mixers MIX are supplied with a local oscillation (LO) signal from an external terminal. Intermediate-frequency-band (IF-band) switching circuits IF-SW1 to IF-SW7 are connected to their respective input sides of the mixers X and selected in response to a control signal from an external terminal.

The signals are therefore transmitted as transmitted waves from the plurality of probes $94_1$ to $94_7$ through the IF-band switching circuits IF-SW1 to IF-SW7, which are selected in response to a control signal from the external terminal, and the transmitting modules TM1 to TM7.

Eighth Embodiment

Figure 27A:
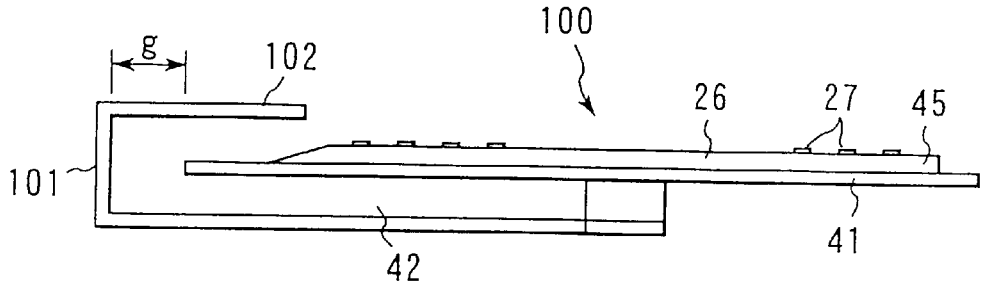
FIGS. 27A, 27B and 27C are side, front, and rear views showing the structure of a planar (single-beam) antenna of a back-folded feed leaky wave antenna array type according to an eighth embodiment of the present invention.
Figure 27B:
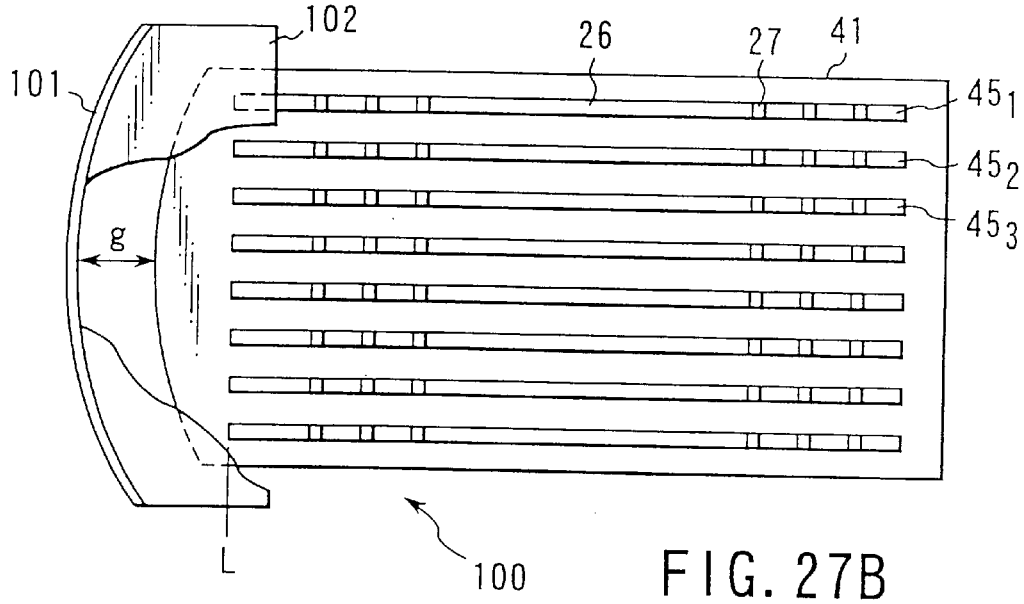
Figure 27C:
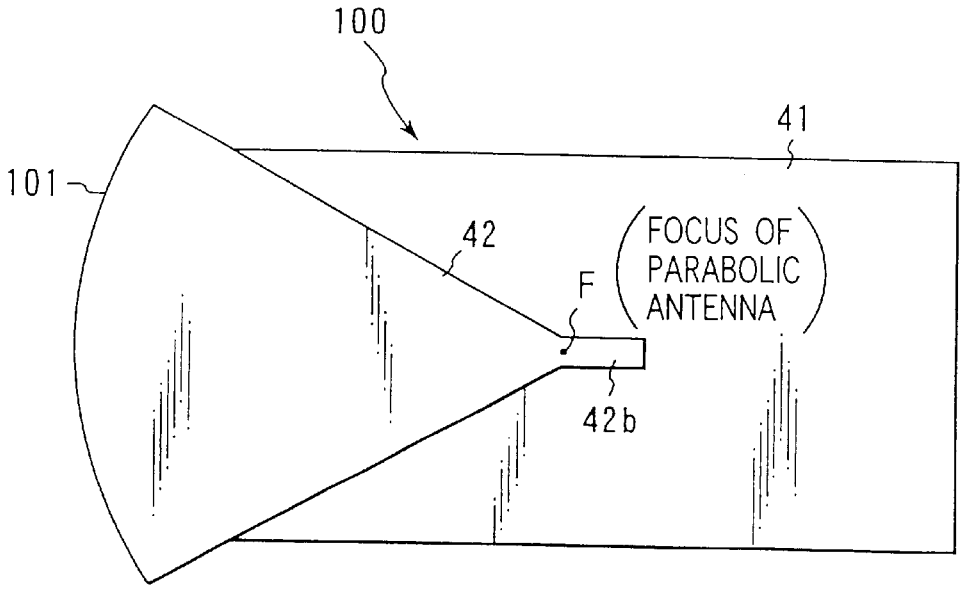

FIGS. 27A, 27B and 27C illustrate a planar (single-beam) antenna 100 of a back-folded feed leaky wave antenna array type according to an eighth embodiment of the present invention.

In the planar (single-beam) antenna 100 according to the eighth embodiment, an H-plane sectoral horn 42 and a feeding radiator 42*b*, as shown in FIGS. 7 and 8, are arranged on the back of a ground conductor 41 of image guide leaky wave antenna elements $45_1$ to $45_8$ and a parabolic cylindrical reflector 101 is disposed at the feeding end of an array antenna such that its focal point F coincides with the phase center of the feeding radiator 42*b*.

The edge of the ground conductor 41 alongside the parabolic cylindrical reflector 101 is formed so as to have the same shape as that of the reflector 101. The edge of the ground conductor 41 and the parabolic cylindrical reflector 101 are arranged at a fixed interval g.

An upper flat plate 102 of a guide is so disposed that a parallel flat plate waveguide is formed between the plate 102 and the surface of the ground conductor 41. All radiating dielectrics 26 are arranged such that their feeding edges are aligned with one another. Thus, a radio wave radiating from the feeding radiator 42*b* does not return thereto but most radio wave is converted into a plane wave and fed to all the radiating dielectrics 26 in equal phases.

In the above arrangement, a radio wave from the feeding radiator 42*b* in the lower stage is propagated widely in the H-plane sectoral horn 42 and then reflected by the parabolic cylindrical reflector 101. The reflected wave changes into a plane wave and enters the radiating dielectric 26 in the upper stage.

All the radiating dielectrics 26 have the same structure (the same elongated portion) and are excited in phase.

In the planar (single-beam) antenna 100 of a back-folded feed leaky wave antenna array type according to the eighth embodiment, an interval g between the edge of the ground conductor 41 and the parabolic cylindrical reflector 101 is chosen appropriately. Therefore, a radio wave radiating from the feeding radiator 42*b* hardly returns thereto but nearly 100 percent thereof is guided to the parallel plate waveguide in the upper stage, with the result that the wave can be fed efficiently.

In the planar antenna 100 described above, a feeding section can be disposed on the back of the antenna, so that the length (depth) of the antenna can be decreased more greatly as compared with the case where a feeding section is arranged on the same side.

A compact antenna can thus be obtained.

In the case of the same-surface arrangement, an elongated portion of each radiating dielectric 26 is shaped like a lens having a curve and thus the manufacture of the antenna is complicated. However, the antenna according to the eighth embodiment is easy to manufacture since the edges of the radiating dielectrics are aligned with one another.

Ninth Embodiment

Figure 28A:
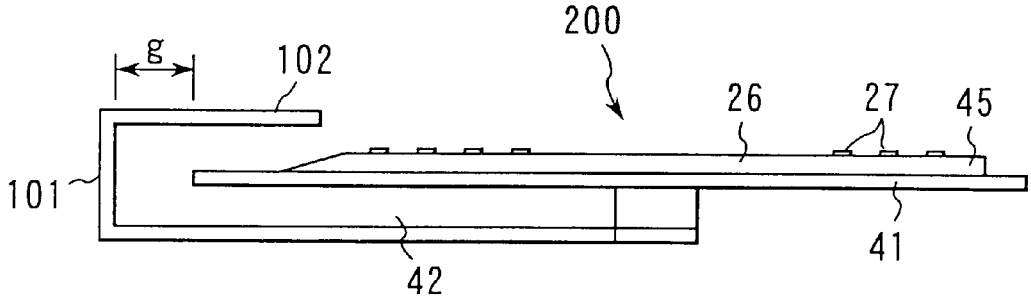
FIGS. 28A, 28B and 28C are side, front, and rear views showing the structure of a planar (multibeam) antenna of a back-folded feed leaky wave antenna array type according to a ninth embodiment of the present invention.
Figure 28B:
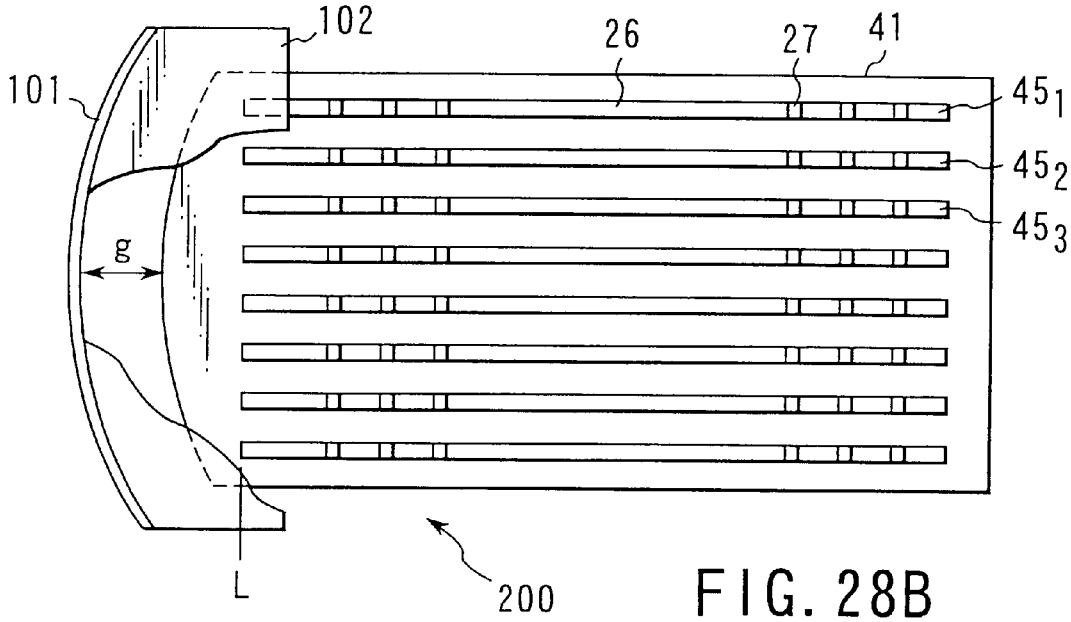
Figure 28C:
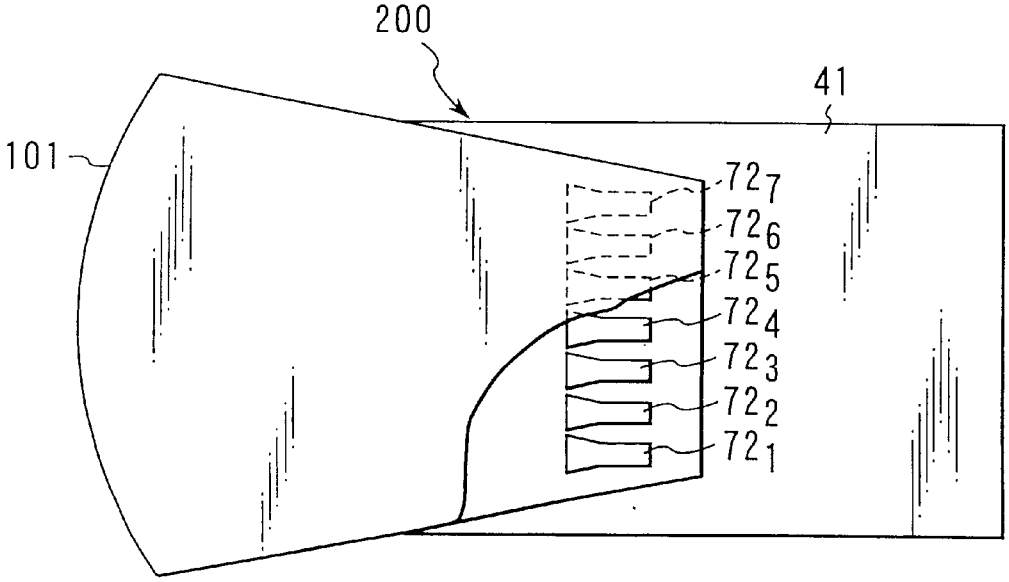

FIGS. 28A, 28B and 28C illustrate a planar (multibeam) antenna 200 of a back-folded feed leaky wave antenna array type according to a ninth embodiment of the present invention.

In the planar (multibeam) antenna 200 according to the ninth embodiment, an H-plane sectoral horn 42 and a radiating feeder 26, as shown in FIGS. 7 and 8, are arranged on the back of a ground conductor 41 of image guide leaky wave antenna elements $\mathbf{45}_1$ to $\mathbf{45}_8$, and a parabolic cylindrical reflector 101 is disposed at the feeding end of an array antenna so as to feed a multibeam as shown in FIG. 12.

Except for the above, the planar antenna of the ninth embodiment is the same as that of the eighth embodiment described above.

Tenth Embodiment

Figure 29A:
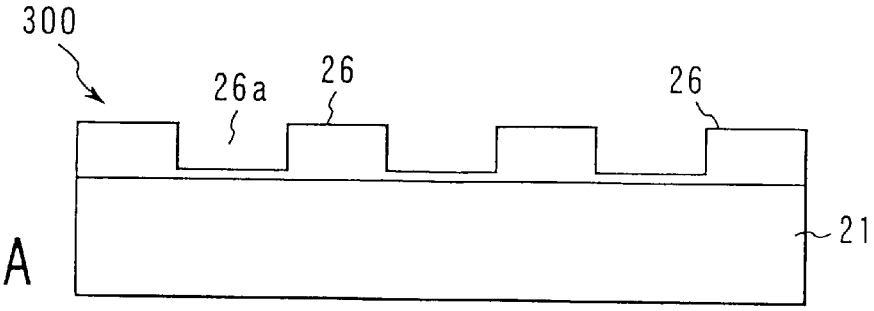
FIGS. 29A and 29B are a side view and an enlarged perspective view showing the structure of a major part of a planar antenna according to a tenth embodiment of the present invention.
Figure 29B:
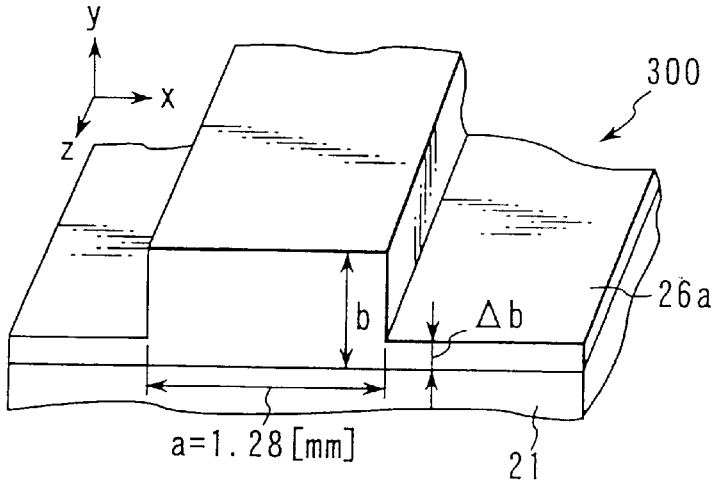

FIGS. 29A and 29B show the major part of a planar antenna 300 according to a tenth embodiment of the present invention.

The planar antenna 300 is manufactured by the grooving method in which a plurality of grooves are formed in parallel in a single sheet-like dielectric substrate.

Except for the above, the planar antenna 300 of the tenth embodiment is the same as that of each of the foregoing embodiments.

More specifically, the planar antenna 300 is manufactured by the above grooving method as follows. A plurality of radiating dielectrics 26 are formed on the top surface of a ground conductor 41 and each dielectric 26*a* remains between adjacent radiating dielectrics 26. The dielectrics 26*a* are formed of the same material as that of the radiating dielectrics 26. The height (Δb) of the dielectric 26*a* is not greater than about ⅔ that (b) of the radiating dielectric 26.

Figure 30:
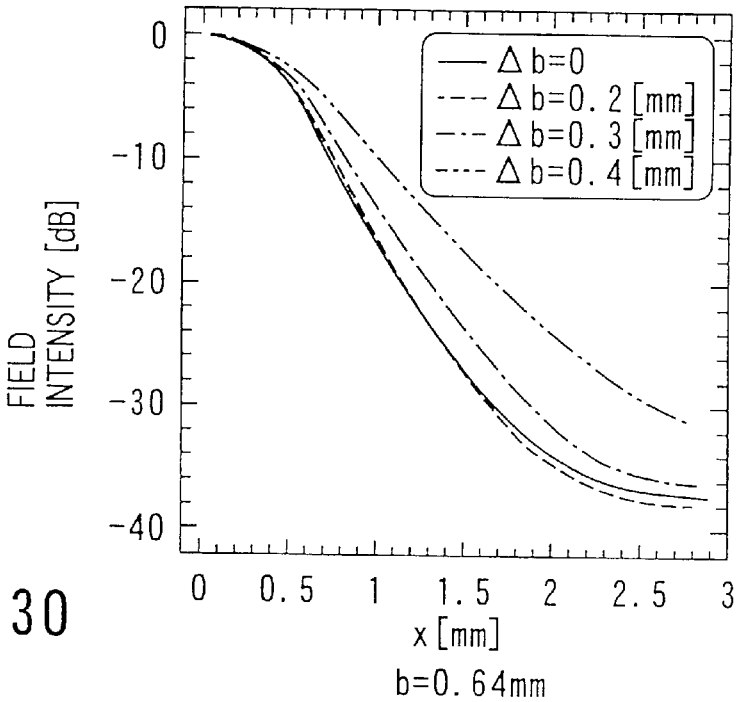
FIG. 30 is a characteristic diagram showing electrical performance of the planar antenna shown in FIGS. 29A and 29B by simulation analysis.

The heights Δb of the dielectrics 26*a* remaining on the top surface of the ground conductor 41 are plotted in FIG. 30 as an electric-field distribution in a vertical section obtained by a simulation analysis. It turns out from FIG. 30 that the electrical performance of the antenna does not deteriorate so greatly if the dielectrics 26*a* are not too thick.

The planar antenna of the tenth embodiment is manufactured by forming a plurality of grooves in parallel in a single sheet-like dielectric substrate. The tenth embodiment can thus be applied to the manufacture of the foregoing array antenna or the planar antenna of each of the above embodiments. The planar antenna of the tenth embodiment is suitable for mass production and can be manufactured at low costs; therefore, its practicability is very high.

As described above, so far no antennas have been manufactured from a single substrate. Since the conventional technique was limited to an array antenna constituted of a plurality of dielectric rods arranged in parallel and separately from one another, it was considered to be problematic in view of mass production.

Other Embodiments

In the above-described embodiments, the number of radiating dielectrics is 8 or 12; however, it can be set freely. As the radiating dielectrics increase in number, a beam width can be narrowed on the plane defined by both a direction in which the radiating dielectrics are aligned and a line intersecting the ground conductor at right angles.

Figure 23:
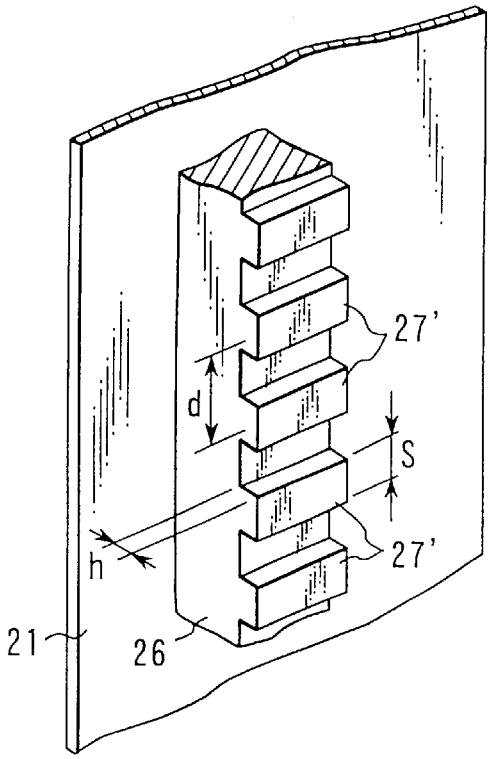
FIG. 23 is a perspective view of a major part showing the structure of a planar antenna according to the other embodiment of the present invention.

In the foregoing embodiments, the metal strips 27 are provided as perturbations on the surface of each of the radiating dielectrics 26 to form an antenna element. As illustrated in FIG. 23, high step portions 27' having a given height h, which serve as perturbations, can be arranged at almost regular intervals on the surface of a radiating dielectric 26, thus forming a corrugated antenna element which leaks an electromagnetic wave.

The interval d (corrugate cycle) between high step portions 27' and the length s (corrugate width) of each of the high step portions 27' correspond to the strip cycle and strip width of the metal strip, respectively. The radiation direction of the antenna elements depends on the corrugate cycle d, while the radiation amount depends on the corrugate width s and the height h of the high step portion 27'.

Advantage of the Invention

In the planar antenna of the present invention as described above, a plurality of leaky wave type antenna elements are formed of dielectrics and arranged in parallel on a ground conductor, and a feeding section is provided on the same plane as that of the antenna elements to receive an electromagnetic wave from one end of each of the antenna elements.

The antenna can thus be assembled to have a thin planar structure and employs an image line for transmitting an electromagnetic wave. Therefore, it can be decreased in transmission loss more greatly than the microstrip antenna; consequently, it is improved in antenna efficiency.

Since the perturbations on the surfaces of the dielectrics can be formed with high dimension precision by printing and etching techniques, the planar antenna of the present invention is improved in terms of mass production capability, has a decreased cost, and is increased in beam synthesis accuracy.

Since, moreover, the feeding section is constituted of an image line, the overall antenna including the feeding section can be thinned further and the feeding section can be manufactured easily.

An elongated portion may be formed at the end of each radiating dielectric constituting an antenna element to have a function corresponding to that of an electromagnetic lens and thus an H-plane sectoral horn can be used as the feeding section. The planar antenna of the present invention can thus be decreased in thickness and increased in efficiency even if it is of a horn feeding type.

In the planar antenna of the present invention, the metal plates are arranged at intervals each corresponding to not shorter than half the wavelength on the upper edge of an aperture of an electromagnetic horn. An electromagnetic wave is inhibited from directly radiating from the aperture of the horn to the outside, and it is efficiently transmitted to each of the antenna elements.

The planar antenna of the present invention is assembled as follows. A bifocal electromagnetic lens is formed by the elongated portions of the radiating dielectrics. The radiating center is located on or near a line connecting two focal points of the bifocal electromagnetic lens or near the line. A plurality of a feeding radiators are disposed on the ground conductor with their radiating faces toward the bifocal electromagnetic lens. A range from the elongated portions to the ends of the feeding radiators is interposed between the guide and ground conductor to convert an electromagnetic wave radiated from the feeding radiators to the elongated portions into a cylindrical wave. The electromagnetic wave radiated from each of the feeding radiators is fed to the plurality of radiating dielectrics with a phase difference corresponding to the position of the radiating center thereof.

The planar antenna of the present invention can be assembled as a planar multibeam antenna whose beam directions vary from feeding radiator to feeding radiator.

In the planar antenna of the present invention, the metal plates are arranged at intervals each corresponding to not shorter than half the wavelength on the upper edge of an aperture of the guide. An electromagnetic wave is inhibited from directly radiating from the aperture of the guide to the outside, and it is efficiently transmitted to each of the antenna elements.

Since the multibeam planar antenna is provided with a switching means for allowing a plurality of feeding radiators to be selectively used, it can perform a beam scan.

The planar antenna of the present invention is also assembled as follows. A plurality of feeding radiators constitute a waveguide whose inner wall is partly formed of a ground conductor. Coupling slots are provided on the inner wall of the waveguide alongside the ground conductor, and a dielectric substrate is formed on the opposite side thereof. A plurality of probes intersecting the coupling slots f the feeding radiators at right angles, a transmit/receive terminal, a plurality of bias terminals, a plurality of diodes whose electrodes are connected to the probes at one end and connected to the transmit/receive terminal at the other end, and a low-pass filter for connecting the electrodes of the plurality of diodes and the bias terminals in a direct-current manner and preventing a high frequency from being transmitted from the diodes to the bias terminals, are arranged on the dielectric substrate. Since, in this planar antenna, a bias voltage is selectively applied through the bias terminal, the feeding radiators can be selected for use and the switching means for beam scanning is simplified. The planar antenna can be made planar, increased in mass production and decreased in costs, and therefore is favorable for a car-mounted radar.

As the above switching circuit, a switching element in a usable radio-frequency band (RF band) can be employed. Since, however, an insertion loss is generally increased in the frequency band corresponding to a millimeter wave, it is effective to connect receiving or transmitting modules each including a frequency converter to their respective probes serving as beam terminals and switch them in an intermediate-frequency (IF) band.

As compared with switching in the RF band, a noise figure can be improved more greatly in the receiving system and so can be transmitted power in the transmitting system.

In a planar (single beam or multibeam) antenna of a back-folded feed leaky wave antenna array type, a feeding section can be disposed on the back of the antenna, so that the length (depth) of the antenna can be decreased more greatly as compared with the case where a feeding section is arranged on the same side.

In the case of the same-surface arrangement, an elongated portion of each radiating dielectric is shaped like a lens having a curve and thus the manufacture of the antenna is complicated. If, however, the feeding section is formed on the back of the antenna, the antenna is easy to manufacture since the edges of the radiating dielectrics are aligned with one another.

A planar antenna is manufactured by forming a plurality of grooves in parallel in a single sheet-like dielectric substrate. It is therefore suitable for mass production and can be decreased in manufacturing costs and increased in practicability.

If cycle d and width s of strips as perturbations are selected appropriately, both the amplitude and phase of an electric field on the aperture of the antenna can freely be controlled. Consequently, a local leaky coefficient is obtained so as to perform a desired distribution of electric fields over the antenna aperture in consideration of a transmission loss of a radiating dielectric line and the strip cycle d and strip width s of each perturbation are controlled; thus, desired directivity can be achieved with high precision.

What is claimed is:

1. A planar antenna comprising:

a planar ground conductor;

a plurality of radiating dielectrics arranged in parallel and at established intervals on a surface of the ground conductor;

a plurality of perturbations for radiating an electromagnetic wave, the perturbations each having a given width and being arranged at established intervals on a top surface of each of the plurality of radiating dielectrics along a longitudinal direction thereof; and a feeding section, provided alongside one end of each of the plurality of radiating dielectrics, for feeding an electromagnetic wave to respective lines formed by each of the radiating dielectrics and the ground conductor;

wherein the ground conductor, the radiating dielectrics, the perturbations, and the feeding section form a plurality of antenna elements which together form a planar antenna;

wherein the antenna elements of the planar antenna are fed with specified amplitudes and phases by the feeding section;

wherein the electromagnetic wave fed by the feeding section comprises electric field components perpendicular to the ground conductor, and the electromagnetic wave is fed to one end of each of the radiating dielectrics; and wherein leaky waves are radiated from the top surface of each of the radiating dielectrics on which the perturbations are arranged, so as to generate a specified radiation pattern with a specified beam direction.

2. The planar antenna according to claim 1, wherein the feeding section includes a feeding image line provided on the surface of the ground conductor so as to separate from the plurality of radiating dielectrics and intersect the plurality of radiating dielectrics at right angles and an input section for supplying an electromagnetic wave to one end of the feeding image line, and the electromagnetic wave input through the input section is fed from a side of the feeding image line to the one end of each of the plurality of radiating dielectrics.

3. The planar antenna according to claim 1, wherein the feeding section includes an electromagnetic horn formed on the ground conductor such that an aperture thereof, on a radiating side, intersects the plurality of radiating dielectrics at right angles.

4. The planar antenna according to claim 3, wherein the electromagnetic horn is an H-plane sectoral horn, and the plurality of radiating dielectrics each have an elongated portion at one end, the elongated portion extending inside the H-plane sectoral horn to convert a cylindrical wave of the H-plane sectoral horn into a plane wave and guide the plane wave to the plurality of radiating dielectrics.

5. The planar antenna according to claim 4, wherein the electromagnetic horn includes a plurality of metal plates on an upper edge of an aperture thereof on the radiating side, the plurality of metal plates, which are parallel with a center axis of the electromagnetic horn and perpendicular to the ground conductor, being arranged at intervals each corresponding to not more than half of a free-space wavelength of the electromagnetic wave so as to interpose each of the radiating dielectrics therebetween.

6. The planar antenna according to claim 3, wherein the electromagnetic horn includes a plurality of metal plates on an upper edge of an aperture thereof on the radiating side, the plurality of metal plates, which are parallel with a center axis of the electromagnetic horn and perpendicular to the ground conductor, being arranged at intervals each corresponding to not more than half of a free-space wavelength of the electromagnetic wave so as to interpose each of the radiating dielectrics therebetween.

7. The planar antenna according to claim 1, wherein the plurality of radiating dielectrics each have an elongated portion at one end, the elongated portion extending toward the feeding section so as to form a bifocal electromagnetic lens, and the feeding section includes:

a plurality of feeding radiators which are arranged on the ground conductor such that a radiation center is located on a line connecting two focal points of the bifocal electromagnetic lens or near the line and a radiation face is directed to the bifocal electromagnetic lens; and a guide for converting an electromagnetic wave radiating from the plurality of feeding radiators into a cylindrical wave and feeding the cylindrical wave to the elongated portions of the radiating dielectrics, ends of the feeding radiators and the elongated portions of the radiating dielectrics being interposed between the guide and the ground conductor, the electromagnetic wave radiating from the plurality of feeding radiators being fed to the plurality of radiating dielectrics with a phase difference corresponding to the radiation center of the electromagnetic wave, and the antenna having beam directions varying from feeding radiator to feeding radiator.

8. The planar antenna according to claim 7, wherein the guide includes a plurality of metal plates on an upper edge of an aperture thereof alongside the plurality of radiating dielectrics, the metal plates, which are parallel with a center line of the bifocal electromagnetic lens and perpendicular to the ground conductor, being arranged at intervals each corresponding to not more than half of a free-space wavelength of the electromagnetic wave so as to interpose each of the radiating dielectrics therebetween.

9. The planar antenna according to claim 8, wherein the beam directions of the antenna are scanned by controlling select means, the select means allowing the plurality of feeding radiators to be used selectively.

10. The planar antenna according to claim 9, wherein the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a transmit/receive terminal formed on the dielectric substrate;

a plurality of diodes mounted on the dielectric substrate, one electrode of each of the diodes being connected to a corresponding one of the probes, and other electrodes of the diodes being connected in common to the transmit/receive terminal;

a plurality of bias terminals for applying a bias voltage to the plurality of diodes from outside; and a plurality of low-pass filters for connecting the bias terminals and the electrodes of the diodes in a direct-current manner on the dielectric substrate, preventing a high frequency from being transmitted from the diodes to the bias terminals, and applying a bias voltage, applied to a bias terminal, to a diode corresponding to the bias terminal.

11. The planar antenna according to claim 9, wherein the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a receiving terminal formed on the dielectric substrate;

a plurality of receiving modules mounted on the dielectric substrate and having inputs connected to the plurality of probes, respectively, each of the receiving modules being constituted of a low-noise amplifier and a mixer;

a terminal for supplying a local oscillation signal to each mixer of the receiving modules from outside; and a plurality of intermediate-frequency-band switches whose inputs are connected to outputs of the plurality of receiving modules, respectively and whose outputs are connected to the receiving terminal.

12. The planar antenna according to claim 9, wherein the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a transmitting terminal formed on the dielectric substrate;

a plurality of transmitting modules mounted on the dielectric substrate and having outputs connected to the plurality of probes, respectively, each of the transmitting modules being constituted of a power amplifier and a mixer;

a terminal for supplying a local oscillation signal to each mixer of the transmitting modules from outside; and a plurality of intermediate-frequency-band switches whose outputs are connected to inputs of the plurality of transmitting modules, respectively and whose inputs are connected to the transmitting terminal.

13. The planar antenna according to claim 7, wherein the beam directions of the antenna are scanned by controlling select means, the select means allowing the plurality of feeding radiators to be used selectively.

14. The planar antenna according to claim 13, wherein the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a transmit/receive terminal formed on the dielectric substrate;

a plurality of diodes mounted on the dielectric substrate, one electrode of each of the diodes being connected to a corresponding one of the probes, and other electrodes of the diodes being connected in common to the transmit/receive terminal;

a plurality of bias terminals for applying a bias voltage to the plurality of diodes from outside; and a plurality of low-pass filters for connecting the bias terminals and the electrodes of the diodes in a direct-current manner on the dielectric substrate, preventing a high frequency from being transmitted from the diodes to the bias terminals, and applying a bias voltage, applied to a bias terminal, to a diode corresponding to the bias terminal.

15. The planar antenna according to claim 13, wherein the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a receiving terminal formed on the dielectric substrate;

a plurality of receiving modules mounted on the dielectric substrate and having inputs connected to the plurality of probes, respectively, each of the receiving modules being constituted of a low-noise amplifier and a mixer;

a terminal for supplying a local oscillation signal to each mixer of the receiving modules from outside; and a plurality of intermediate-frequency-band switches whose inputs are connected to outputs of the plurality of receiving modules, respectively and whose outputs are connected to the receiving terminal.

16. The planar antenna according to claim 13, wherein the plurality of feeding radiators have a waveguide structure whose inner wall partly corresponds to the ground conductor, and the ground conductor includes coupling slots on the inner walls of the feeding radiators, and the select means comprises:

a dielectric substrate fixed on opposite sides of the plurality of feeding radiators with the ground conductor interposed therebetween;

a plurality of probes formed on the dielectric substrate so as to cross the coupling slots of the plurality of feeding radiators with the dielectric substrate interposed therebetween;

a transmitting terminal formed on the dielectric substrate;

a plurality of transmitting modules mounted on the dielectric substrate and having outputs connected to the plurality of probes, respectively, each of the transmitting modules being constituted of a power amplifier and a mixer;

a terminal for supplying a local oscillation signal to each mixer of the transmitting modules from outside; and a plurality of intermediate-frequency-band switches whose outputs are connected to inputs of the plurality of transmitting modules, respectively and whose inputs are connected to the transmitting terminal.

17. The planar antenna according to claim 1, wherein the feeding section comprises:

an H-plane sectoral horn provided on a back of the ground conductor and having a feeding radiator;

a parabolic cylindrical reflector coupled at one end to an end portion of the H-plane sectoral horn and disposed at a feeding end of the radiating dielectric such that a focal point coincides with a phase center of the radiating dielectric; and an upper plate coupled to another end of the parabolic cylindrical reflector to thereby form a parallel plate waveguide between the upper plate and the ground conductor, and an electromagnetic wave returns from the back of the ground conductor to the surface thereof with a single beam.

18. The planar antenna according to claim 1, wherein the feeding section comprises:

an H-plane sectoral horn provided on a back of the ground conductor and having a feeding radiator;

a parabolic cylindrical reflector coupled at one end to an end portion of the H-plane sectoral horn and disposed at a feeding end of the radiating dielectric such that a focal point coincides with a phase center of the radiating dielectric; and an upper plate coupled to another end of the parabolic cylindrical reflector to thereby form a parallel plate waveguide between the upper plate and the ground conductor, and an electromagnetic wave returns from the back of the ground conductor to the surface thereof with a multi-beam.

19. The planar antenna according to claim 1, wherein a dielectric, which is formed of a same material as that of the radiating dielectric, expands over a top surface of the ground conductor, and a height of the dielectric is not greater than about ⅔ that of the radiating dielectric.

20. The planar antenna according to claim 1, wherein the plurality of perturbations each have a given width corresponding a position thereof, and an interval between adjacent perturbations is set to a nonuniform value.

21. The planar antenna according to claim 1, wherein the feeding section includes:

a feeding radiator closed at one end opposed to a radiation face;

a coupling slot provided on the ground conductor, which forms an inner wall of the feeding radiator, in a direction perpendicular to a longitudinal direction of the feeding radiator;

a dielectric substrate mounted on a back of the ground conductor in a position corresponding to the feeding radiator; and a probe formed on the dielectric substrate so as to cross the coupling slot at one end, for transmitting an input electromagnetic wave.

22. A method for manufacturing a planar antenna, comprising:

a step of preparing a planar ground conductor;

a step of preparing a plurality of radiating dielectrics to be arranged in parallel and at established intervals on a surface of the ground conductor;

a step of preparing a plurality of perturbations for radiating an electromagnetic wave, the perturbations each having a given width (s) and arranged at established intervals (d) on a top surface of each of the plurality of radiating dielectrics along a longitudinal direction thereof;

a step of previously plotting a curve group of fixed radiant quantities or leaky coefficients for each wavelength of the electromagnetic wave radiated from the plurality of perturbations and a curve group of fixed beam directions with respect to the width (s) and the intervals (d), and preparing a given number of interpolated curve groups, thereby obtaining the width (s) and the intervals (d) from an intersection point between a curve of an arbitrary leaky coefficient and that of an arbitrary beam direction; and a step of preparing a feeding section to be arranged alongside one end of each of the plurality of radiating dielectrics, for feeding an electromagnetic wave to lines constituted of the radiating dielectrics and the ground conductor.

* * * * *

UNITED STATES PATENT AND TRADEMARK OFFICE

CERTIFICATE OF CORRECTION

PATENT NO. : 6,317,095 B1
DATED : November 13, 2001
INVENTOR(S) : Tasuku Teshirogi et al.

It is certified that error appears in the above-identified patent and that said Letters Patent is hereby corrected as shown below:

Title page,
Item [30], Foreign Application Priority Data, change "Dec. 11, 1998" to
-- Dec. 17, 1998 --.

Signed and Sealed this

Third Day of September, 2002

*Attest:*

*Attesting Officer*

JAMES E. ROGAN
*Director of the United States Patent and Trademark Office*